US011693357B2

(12) United States Patent
Nagai et al.

(10) Patent No.: US 11,693,357 B2
(45) Date of Patent: Jul. 4, 2023

(54) IMAGE FORMING APPARATUS WITH CONTROLABLE FAN

(71) Applicant: Brother Kogyo Kabushiki Kaisha, Nagoya (JP)

(72) Inventors: Takuya Nagai, Nagoya (JP); Keisuke Manoh, Iwakura (JP); Yuya Harada, Anjo (JP); Yoshiyuki Tsujimoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/411,308

(22) Filed: Aug. 25, 2021

(65) Prior Publication Data

US 2022/0066388 A1 Mar. 3, 2022

(30) Foreign Application Priority Data

Aug. 28, 2020 (JP) ..... JP2020-144829
Aug. 24, 2021 (JP) ..... JP2021-136108

(51) Int. Cl.
*G03G 21/00* (2006.01)
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 2221/1645; B41J 29/377
USPC ..... 399/92, 94
See application file for complete search history.

(56) References Cited

U.S. PATENT DOCUMENTS 5,144,366 A * 9/1992 Sakamoto ..... G03G 21/206 399/92
2002/0054770 A1* 5/2002 Kimizuka ..... G03G 21/206 399/92
2009/0167228 A1* 7/2009 Chung ..... H05K 7/20209 318/473

(Continued)

FOREIGN PATENT DOCUMENTS

JP H09-222842 A 8/1997
JP H11-143341 A 5/1999

(Continued)

*Primary Examiner* — Robert B Beatty
(74) *Attorney, Agent, or Firm* — Burr Patent Law, PLLC

(57) ABSTRACT

An image forming apparatus including: an image forming device provided in a housing; a fan to cool an interior of the housing; an AC/DC board; a first temperature detecting element configured to output a signal corresponding to a temperature in the housing; a second temperature detecting element configured to output a signal corresponding to a temperature of an element mounted on the AC/DC board; and a controller configured to control the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold.

23 Claims, 12 Drawing Sheets

| | OPERATION OF FAN | THRESHOLD NAME | MANUFACTURER 1 | MANUFACTURER 2 | REMARKS |
|---|---|---|---|---|---|
| FIRST TEMPERATURE SENSOR IN HOUSING | HALF SPEED ON | TH1A | 36°C | 36°C | FAN SPEED CHANGES TO HALF SPEED WHEN T1 BECOMES NOT LESS THAN LISTED TEMPERATURE |
| | FULL SPEED ON | TH2A | 37°C | 37°C | FAN SPEED CHANGES TO FULL SPEED WHEN T1 BECOMES NOT LESS THAN LISTED TEMPERATURE |
| | FULL SPEED ON | TP1 | 41°C | 41°C | PRINTING IS SUSPENDED WHEN T1 BECOMES NOT LESS THAN LISTED TEMPERATURE |
| | FULL SPEED ON | TP2 | 40°C | 40°C | PRINTING RESTARTS WHEN T1 BECOMES NOT GREATER THAN LISTED TEMPERATURE |
| | FULL SPEED OFF | TH3A | 36°C | 36°C | FAN SPEED MAY CHANGE TO HALF SPEED WHEN T1 BECOMES NOT GREATER THAN LISTED TEMPERATURE |
| | HALF SPEED OFF | TH4A | 30°C | 30°C | FAN MAY BE TURNED OFF WHEN T1 BECOMES NOT GREATER THAN LISTED TEMPERATURE |
| SECOND TEMPERATURE SENSOR OF AC/DC BOARD | HALF SPEED ON | TH1B | 75°C | 80°C | FAN SPEED CHANGES TO HALF SPEED WHEN T2 BECOMES NOT LESS THAN LISTED TEMPERATURE |
| | FULL SPEED ON | TH2B | 100°C | 110°C | FAN SPEED CHANGES TO FULL SPEED WHEN T2 BECOMES NOT LESS THAN LISTED TEMPERATURE |
| | FULL SPEED OFF | TH3B | 95°C | 105°C | FAN SPEED MAY CHANGE TO HALF SPEED WHEN T2 BECOMES NOT GREATER THAN LISTED TEMPERATURE |
| | HALF SPEED OFF | TH4B | 70°C | 75°C | FAN MAY BE TURNED OFF WHEN T2 BECOMES NOT GREATER THAN LISTED TEMPERATURE |

(56) References Cited

U.S. PATENT DOCUMENTS

| | | | | |
|---|---|---|---|---|
| 2010/0158557 | A1* | 6/2010 | Kuroda | G03G 21/206 399/92 |
| 2013/0045020 | A1* | 2/2013 | Kaneko | B41J 29/38 399/67 |
| 2013/0251385 | A1* | 9/2013 | Mitourida | G03G 21/206 399/92 |
| 2015/0241841 | A1* | 8/2015 | Sakurai | G03G 21/206 399/92 |
| 2016/0031242 | A1* | 2/2016 | Sasaki | B41J 29/13 347/17 |
| 2020/0233479 | A1* | 7/2020 | Tsukamoto | G06F 1/266 |

FOREIGN PATENT DOCUMENTS

| | | | | |
|---|---|---|---|---|
| JP | H11-198492 | A | 7/1999 | |
| JP | 2002-229417 | A | 8/2002 | |
| JP | 2004-309900 | A | 11/2004 | |
| WO | WO-2018101561 | A1 * | 6/2018 | B41J 29/377 |

* cited by examiner

FIG.4

| | OPERATION OF FAN | THRESHOLD NAME | MANUFACTURER 1 | MANUFACTURER 2 | REMARKS |
|---|---|---|---|---|---|
| FIRST TEMPERATURE SENSOR IN HOUSING | HALF SPEED ON | TH1A | 36°C | 36°C | FAN SPEED CHANGES TO HALF SPEED WHEN T1 BECOMES NOT LESS THAN LISTED TEMPERATURE |
| | FULL SPEED ON | TH2A | 37°C | 37°C | FAN SPEED CHANGES TO FULL SPEED WHEN T1 BECOMES NOT LESS THAN LISTED TEMPERATURE |
| | FULL SPEED ON | TP1 | 41°C | 41°C | PRINTING IS SUSPENDED WHEN T1 BECOMES NOT LESS THAN LISTED TEMPERATURE |
| | FULL SPEED ON | TP2 | 40°C | 40°C | PRINTING RESTARTS WHEN T1 BECOMES NOT GREATER THAN LISTED TEMPERATURE |
| | FULL SPEED OFF | TH3A | 36°C | 36°C | FAN SPEED MAY CHANGE TO HALF SPEED WHEN T1 BECOMES NOT GREATER THAN LISTED TEMPERATURE |
| | HALF SPEED OFF | TH4A | 30°C | 30°C | FAN MAY BE TURNED OFF WHEN T1 BECOMES NOT GREATER THAN LISTED TEMPERATURE |
| SECOND TEMPERATURE SENSOR OF AC/DC BOARD | HALF SPEED ON | TH1B | 75°C | 80°C | FAN SPEED CHANGES TO HALF SPEED WHEN T2 BECOMES NOT LESS THAN LISTED TEMPERATURE |
| | FULL SPEED ON | TH2B | 100°C | 110°C | FAN SPEED CHANGES TO FULL SPEED WHEN T2 BECOMES NOT LESS THAN LISTED TEMPERATURE |
| | FULL SPEED OFF | TH3B | 95°C | 105°C | FAN SPEED MAY CHANGE TO HALF SPEED WHEN T2 BECOMES NOT GREATER THAN LISTED TEMPERATURE |
| | HALF SPEED OFF | TH4B | 70°C | 75°C | FAN MAY BE TURNED OFF WHEN T2 BECOMES NOT GREATER THAN LISTED TEMPERATURE |

IMAGE FORMING APPARATUS WITH CONTROLABLE FAN

CROSS REFERENCE TO RELATED APPLICATION

The present application claims priority to Japanese Patent Applications No. 2020-144829 filed on Aug. 28, 2020 and No. 2021-136108 filed on Aug. 24, 2021, the disclosure of which is herein incorporated by reference in its entirety.

BACKGROUND

Technical Field

The following disclosure relates to a control of a fan in an image forming apparatus.

Description of Related Art

Various image forming apparatus having a fan for cooling an interior of the apparatus have been proposed. For instance, an image forming apparatus includes a switching power source for converting an alternating current (AC) voltage supplied from a commercial power source into a direct current (DC) voltage. A thermistor is attached to a heat dissipating plate of the switching power source. When a detection temperature detected by the thermistor exceeds a predetermined temperature, the fan in the image forming apparatus is rotated to cool the interior of the apparatus.

SUMMARY

In the image forming apparatus described above, the fan is controlled based on the detection temperature by the thermistor provided in the switching power source. In this type of image forming apparatus, it is desired to not only merely drive the fan depending on whether the detection temperature detected by the temperature detecting element such as the thermistor provided in the switching power source exceeds the predetermined temperature, but also control the fan in consideration of other factors giving an influence on a temperature that causes the fan to be driven.

An aspect of the present disclosure is directed to an image forming apparatus capable of controlling a fan in consideration of a plurality of factors giving an influence on a temperature that causes the fan to be driven.

In one aspect of the present disclosure, an image forming apparatus includes: a housing; an image forming device provided in an interior of the housing; a fan configured to cool the interior of the housing; an AC/DC board configured to convert an AC voltage supplied from an AC power source into a DC voltage; a first temperature detecting element configured to output a signal corresponding to a temperature in the housing; a second temperature detecting element configured to output a signal corresponding to a temperature of an element mounted on the AC/DC board; and a controller connected to the first temperature detecting element and the second temperature detecting element, wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold.

In another aspect of the present disclosure, an image forming apparatus includes: a housing; an image forming device provided in an interior of the housing; a fan configured to cool the interior of the housing; an AC/DC board configured to convert an AC voltage supplied from an AC power source to a DC voltage; a temperature detecting element configured to output a signal corresponding to a temperature of an element mounted on the AC/DC board; and a controller connected to the temperature detecting element, the controller being configured to control the fan when a detection temperature detected based on the signal received from the temperature detecting element becomes not less than a temperature threshold, wherein the controller is configured to: obtain followability information that is information on followability of the temperature detecting element with respect to the temperature of the element mounted on the AC/DC board; and modify, based on the followability information, a condition for determining whether the detection temperature is not less than the temperature threshold.

VARIOUS FORMS

There will be hereinafter described various forms of the present disclosure. It is to be understood that the present disclosure is not limited to the forms described below but may be otherwise embodied.

An image forming apparatus is provided, including: a housing; an image forming device provided in an interior of the housing; a fan configured to cool the interior of the housing; an AC/DC board configured to convert an AC voltage supplied from an AC power source into a DC voltage; a first temperature detecting element configured to output a signal corresponding to a temperature in the housing; a second temperature detecting element configured to output a signal corresponding to a temperature of an element mounted on the AC/DC board; and a controller connected to the first temperature detecting element and the second temperature detecting element, wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold.

The image forming apparatus constructed as described above includes the first temperature detecting element that outputs the signal corresponding to the temperature of the interior of the housing, in addition to the second temperature detecting element that outputs the signal corresponding to the temperature of the element mounted on the AC/DC board. The controller controls the fan when at least one of the first detection temperature by the first temperature detecting element and the second detection temperature by the second temperature detecting element becomes not less than the corresponding temperature threshold. With this configuration, a plurality of factors giving an influence on the temperature that causes the fan to be driven are evaluated or recognized utilizing the two temperature sensors, so as to execute a control of starting to drive the fan, a control of changing a rotation speed of the fan being driven, etc. That is, the fan can be driven at appropriate timing in accordance with the temperature state.

In the image forming apparatus constructed as described above, the controller may be configured to: receive an image forming job that instructs formation of an image by the image forming device; and keep the fan stopped when both the first condition and the second condition are not satisfied for a predetermined length of time after starting to execute the image forming job.

With this configuration, in a case where the controller receives the image forming job, the controller keeps the fan stopped when both the first condition and the second condition are not satisfied for the predetermined length of time. In this configuration, even when the image forming device executes the image formation based on the image forming job, the fan is stopped for the predetermined length of time, resulting in a reduction of a noise generated from the fan. Accordingly, the image formation can be performed with a reduced operating noise by adjusting the predetermined length of time.

In the image forming apparatus constructed as described above, the controller may start to control the fan when the predetermined length of time elapses after receiving the image forming job even if both the first condition and the second condition are not satisfied.

With this configuration, the controller causes the fan to operate so as to perform cooling the interior of the apparatus when the predetermined length of time elapses even if both the first condition and the second condition are not satisfied. With this configuration, in a case where the image formation is performed for not less than the predetermined length of time, the fan is operated to obviate a temperature rise in the apparatus.

In the image forming apparatus constructed as described above, the image forming job may be a print job that instructs execution of printing by the image forming device.

With this configuration, the controller keeps the fan stopped until the predetermined length of time elapses even after the print job is received and the image forming device starts printing. This configuration enables printing to be executed with a reduced operating noise.

In the image forming apparatus constructed as described above, the controller may be configured to set a target rotation speed at which the fan is rotated when the predetermined length of time elapses so as to be equal to a target rotation speed at which the fan is rotated when at least one of the first condition and the second condition is satisfied.

With this configuration, the target rotation speed of the fan when the predetermined length of time elapses is made equal to the target rotation speed of the fan when the first and second conditions are satisfied, thus simplifying contents of the processing executed by the controller that controls the fan.

In the image forming apparatus constructed as described above, the controller may be configured to set a target rotation speed at which the fan is rotated when the first condition is satisfied so as to be equal to a target rotation speed at which the fan is rotated when the second condition is satisfied.

With this configuration, the target rotation speed of the fan when the first condition is satisfied is made equal to the target rotation speed of the fan when the second condition is satisfied, thus simplifying contents of the processing executed by the controller that controls the fan.

In the image forming apparatus constructed as described above, the controller may be configured to set a target rotation speed at which the fan is rotated when only one of the first condition and the second condition is satisfied so as to be equal to a target rotation speed at which the fan is rotated when both the first condition and the second condition are satisfied.

With this configuration, the target rotation speed of the fan when one of the first condition and the second condition is satisfied is made equal to the target rotation speed of the fan when both the first condition and the second condition are satisfied, thus simplifying contents of the processing executed by the controller that controls the fan.

The image forming apparatus constructed as described above may further include a heater, the image forming device may form, on a sheet, a toner image with toner, and the heater may heat the sheet to fix the toner image on the sheet. The controller may be configured to: obtain a turn-on cumulative value that is a sum of the number of turn-ons by which the heart is turned on; and start to control the fan when the turn-on cumulative value becomes not less than a cumulative threshold.

With this configuration, the controller starts to control the fan based on not only the first and second detection temperatures respectively detected by the first and second temperature detecting elements but also the number of turn-ons of the heater. In this configuration, the fan is driven for performing cooling when the temperature rise occurs due to the turn-on of the heater even though the temperature of the detecting target of each of the first and second temperature detecting elements does not rise.

In the image forming apparatus constructed as described above, the controller may be configured to: obtain followability information that is information on followability of the second temperature detecting element with respect to the temperature of the element mounted on the AC/DC board; and modify the second condition based on the followability information.

This configuration enables the second condition to be modified depending on a degree of the followability. To modify the second condition means to modify the readiness with which the second condition is satisfied. Even in a situation in which a change in the detection temperature is delayed with respect to a change in an actual temperature of the element and the followability is accordingly low, it is possible to prevent the temperature of the element (as the temperature detecting target) from exceeding a rated temperature (i.e., a temperature according to temperature rating), by permitting the second condition to be readily satisfied. Further, in a situation in which the followability is high, it is possible to prevent the fan to unnecessarily rotate by making second condition severe while preventing the temperature of the element (as the detection target) from exceeding the rated temperature.

In the image forming apparatus constructed as described above, as a processing of modifying the second condition, the controller may set the second temperature threshold when the followability information indicative of low followability is obtained so as to be lower than the second temperature threshold when the followability information indicative of high followability is obtained.

With this configuration, the second temperature threshold is lowered when the followability is low, thereby permitting the second condition to be readily satisfied. It is thus possible to prevent the temperature of the element (as the temperature detection target) from exceeding the rated temperature.

The image forming apparatus constructed as described above may further include a heater, the image forming device may form, on a sheet, a toner image with toner, and the heater may heat the sheet to fix the toner image on the sheet. The controller may be configured to: obtain a turn-on cumulative value that is a sum of the number of turn-ons by which the heart is turned on; start to control the fan when the turn-on cumulative value becomes not less than a cumulative threshold; obtain followability information that is information on followability of the second temperature detecting element with respect to the temperature of the element mounted on the AC/DC board; and set the cumulative threshold when the followability information indicative of low followability is obtained so as to be lower than the cumulative threshold when the followability information indicative of high followability is obtained.

With this configuration, the controller starts to control the fan based on not only the first and second detection temperatures respectively detected by the first and second temperature detecting elements but also the number of turn-ons of the heater. In this configuration, the fan is driven for performing cooling when the temperature rise occurs due to the turn-on of the heater even though the temperature of the detecting target of each of the first and second temperature does not rise.

Further, by correcting the cumulative threshold depending on the degree of the followability, it is possible to prevent the temperature of the element (as the temperature detection target) from exceeding the rated temperature and to prevent the fan from unnecessarily rotating.

In the image forming apparatus constructed as described above, the followability information may be information indicative of a type of the AC/DC board.

Depending upon the type of the AC/DC board, a size of a heat sink, a circuit constant, a distance between the element (as the temperature detection target) and the second temperature detecting element, etc., are different among different types of the AC/DC board. Accordingly, the followability of the second temperature detecting element with respect to the temperature of the element (as the temperature detection target) varies. In the above configuration, therefore, the controller determines the degree of the followability based on the type of the AC/DC board, thus preventing the temperature of the element (as the temperature detection target) from exceeding the rated temperature and preventing the fan from unnecessarily rotating.

The image forming apparatus constructed as described above may further include a switch element, the controller may include an input port, the input port may be configured such that a first signal of the second temperature detecting element and a second signal corresponding to the type of the AC/DC board are input thereto, and the switch element may be configured to switch a signal input to the input port between the first signal and the second signal. The controller may be configured to control the switch element to switch the signal input to the input port such that the second signal is input to the input port.

With this configuration, the first signal of the second temperature detecting element and the second signal for identifying the type of the AC/DC board are input to the controller through the common input port, thus reducing the number of input ports necessary for the controller. On start-up, for instance, the controller controls the switch element to input the second signal to the input port, thus making it possible to identify the type of the board and modify the second condition in accordance with the degree of the followability, without influencing the image forming process.

In the image forming apparatus constructed as described above, the AC/DC board may include: a transformer; a primary-side element connected to a primary side of the transformer; and a secondary-side element connected to a secondary side of the transformer. The controller may be configured to receive an image forming job that instructs formation of an image by the image forming device, and the followability information may be information indicating whether the image forming job is a first image forming job that causes a temperature of the secondary-side element to reach a rated temperature earlier than a temperature of the primary-side element or a second image forming job that causes the temperature of the primary-side element to reach a rated temperature earlier than the temperature of the secondary-side element.

In a case where the element, as the temperature detection target of the second temperature detecting element, is the primary-side element of the transformer, it is necessary to estimate the temperature of the secondary-side element based on the second detection temperature by the second temperature detecting element. Consequently, when the fan is controlled based on the temperature of the secondary-side element, the followability with respect to an actual temperature change of the secondary-side element is lowered due to the estimation. It is therefore necessary to lower the second temperature threshold so as to permit the second condition to be readily satisfied. On the other hand, in a case where the element, as the temperature detection target of the second temperature detecting element, is the secondary-side element of the transformer, it is necessary to estimate, for instance, the temperature of the primary-side element.

In the above configuration, the degree of the followability with respect to the job can be determined based on i) the information as to on which one of the primary side and the secondary side the second temperature detecting element is disposed and ii) the followability information indicative of which one of the temperature of the primary-side element and the temperature of the secondary-side element is raised up to the rated temperature by the received image forming job earlier than the other. Accordingly, the second condition can be modified depending upon the degree of the followability.

In the image forming apparatus constructed as described above, the second temperature detecting element may be configured to detect the temperature of the secondary-side element, and the controller may be configured to determine the first image forming job as information indicative of high followability and determine the second image forming job as information indicative of low followability.

In an arrangement in which the second temperature detecting element is disposed so as to detect the temperature of the secondary-side element, when the second image forming job is received, a rise in the temperature of the secondary-side element, namely, a rise in the detection temperature by the second temperature detecting element, may be delayed as compared with a rise in the temperature of the primary-side element. In this case, the followability is high with respect to the first image forming job that causes the temperature of the secondary-side element to reach the rated temperature earlier than the temperature of the primary-side element while the followability is low with respect to the second image forming job that causes the temperature of the primary-side element to reach the rated temperature earlier than the temperature of the secondary-side element. By setting the degree of the followability in accordance with the characteristic of the image forming job, the second condition can be appropriately modified.

The image forming apparatus constructed as described above may further include a heater and a triac configured to switch energization to the heater.

The image forming device may form, on a sheet, a toner image with toner, the heater may heat the sheet to fix the toner image on the sheet, the primary-side element may be the triac, the second image forming job may be a print job that causes the image forming device to execute printing, and the first image forming job may be a job that causes the image forming device to execute formation of an image other than the printing.

Execution of the print job requires heating by the heater. In this case, the triac on the primary side is activated, and the temperature of the triac (the primary-side element) accordingly rises. In the first image forming job, such as a scan job or a FAX job, which does not cause the heater to operate, on the other hand, the triac is not activated. In this case, the temperature of the primary-side element does not rise but the temperature of the secondary-side element rises. Thus, in a case where the triac is the primary-side element, the degree of the followability can be determined based on whether a job to be executed is the print job, so that the second condition can be appropriately modified.

In the image forming apparatus constructed as described above, in a case where normal information is not obtained as the followability information, the controller may drive the fan irrespective of the first detection temperature and the second detection temperature when formation of an image by the image forming device is executed.

When the image formation by the image forming device is executed in a situation in which normal (appropriate) information cannot be obtained as the followability information used for modifying the second condition and for setting the cumulative threshold, the fan is driven to perform cooling irrespective of the first and the second detection temperatures. With this configuration, in the event of some malfunction that influences the fan control such as a failure of a circuit for obtaining the followability information, the fan is driven without stopping always when the image formation is executed, thus suppressing a temperature rise in the housing.

In the image forming apparatus constructed as described above, the AC/DC board may include a step-down transformer and a secondary-side element connected to a secondary side of the step-down transformer, and the second temperature detecting element may be configured to detect a temperature of the secondary-side element.

In a case where the second temperature detecting element is provided on the primary side of the step-down transformer, the second temperature detecting element is inevitably disposed on a high-voltage side. In this case, it is needed to insulate the second temperature detecting element and a signal path through which the detection signal of the second temperature detecting element is input to the controller. However, this may leads to a size increase of the AC/DC board. The configuration in which the second temperature detecting element is provided on a low-voltage secondary side eliminates insulation described above, thus achieving a size reduction of the AC/DC board.

In the image forming apparatus constructed as described above, the secondary-side element may be a rectifying diode connected to the secondary side of the step-down transformer.

In this configuration, the element (as the temperature detection target of the second temperature detecting element) is the rectifying diode configured to generate heat by an electric current that flows through the transformer. This configuration enables appropriate detection of the temperature rise of the AC/DC board.

In the image forming apparatus constructed as described above, the AC/DC board may include a step-down transformer and a primary-side element connected to a primary side of the step-down transformer, and the second temperature detecting element may be configured to detect a temperature of the primary-side element.

In a case where the AC/DC board is connected to the power source of a 100 V system or the power source of a 200 V system, more electric current flows on the primary side in the 100 V system than in the 200 V system if the output on the secondary side is the same. In this case, the temperature on the primary side may be higher in the 100 V system than in the 200 V system. Accordingly, in a case where the voltage on the primary side is lower, the second temperature detecting element may be disposed to detect the temperature of the primary-side element, thus enabling appropriate detection of the temperature rise of the AC/DC board.

The image forming apparatus constructed as described above may further include a heater and a triac connected to the primary side of the step-down transformer and configured to switch energization to the heater, and the primary-side element may be the triac.

In this configuration, the element, as the temperature detection target of the second temperature detecting element, is the triac that generates heat by the energization to the heater, thus enabling appropriate detection of the temperature rise of the AC/DC board.

The image forming apparatus constructed as described above may further include: an enclosure that houses the AC/DC board; a heater that heats the sheet on which the image is formed by the image forming device; and a third temperature detecting element configured to detect a temperature of the heater, and the first temperature detecting element may be disposed outside the enclosure at a position at which the first temperature detecting element is farther from the heater than the third temperature detecting element is from the heater and at which the first temperature detecting element is capable of detecting a temperature of the image forming device.

The temperature in the housing of the image forming apparatus rises due to not only heat generation of the AC/DC board and the heater but also heat generation of the image forming device. In this configuration, the temperature detection target of the first temperature detecting element is the image forming device itself, so that the temperature rise in the image forming device can be detected by the first temperature detecting element, and the fan can be rotated at appropriate timing.

In the image forming apparatus constructed as described above, when at least one of the first condition and the second condition is satisfied, the controller may execute one of a control of driving the fan being stopped, a control of maintaining a rotation speed of the fan being driven, and a control of increasing the rotation speed of the fan.

In this configuration, when at least one of the first detection temperature by the first temperature detecting element and the second detection temperature by the second temperature detecting element becomes not less than the corresponding temperature threshold, the controller executes a control of driving the fan, a control of maintaining the rotation speed of the fan, or a control of increasing the rotation speed, so as to perform cooling the interior of the housing.

An image forming apparatus is provided, including: a housing; an image forming device provided in an interior of the housing; a fan configured to cool the interior of the housing; an AC/DC board configured to convert an AC voltage supplied from an AC power source to a DC voltage; a temperature detecting element configured to output a signal corresponding to a temperature of an element mounted on the AC/DC board; and a controller connected to the temperature detecting element, the controller being configured to control the fan when a detection temperature detected based on the signal received from the temperature detecting element becomes not less than a temperature threshold, wherein the controller is configured to: obtain followability information that is information on followability of the temperature detecting element with respect to the temperature of the element mounted on the AC/DC board; and modify, based on the followability information, a condition for determining whether the detection temperature is not less than the temperature threshold.

With this configuration, the image forming device can modify a determining condition for determining whether the detection temperature is not less than the temperature threshold based on the degree of the followability. Even in a situation in which a change in the detection temperature is delayed with respect to an actual temperature of the element and the followability is accordingly low, for instance, it is possible to prevent the temperature of the element (as the temperature defection target) from exceeding the rated temperature by permitting the determining condition to be readily satisfied. By utilizing the detection temperature and the followability information, a plurality of factors giving an influence on the temperature that causes the fan to be driven can be taken into account. It is thus possible to execute a control of starting to drive the fan, a control of changing the rotation speed of the fan being driven, etc.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which:

FIG. 4 is a table illustrating a relationship between control details of the fan and thresholds;

DETAILED DESCRIPTION OF THE EMBODIMENTS

1. Configuration of Printer

Figure 1:
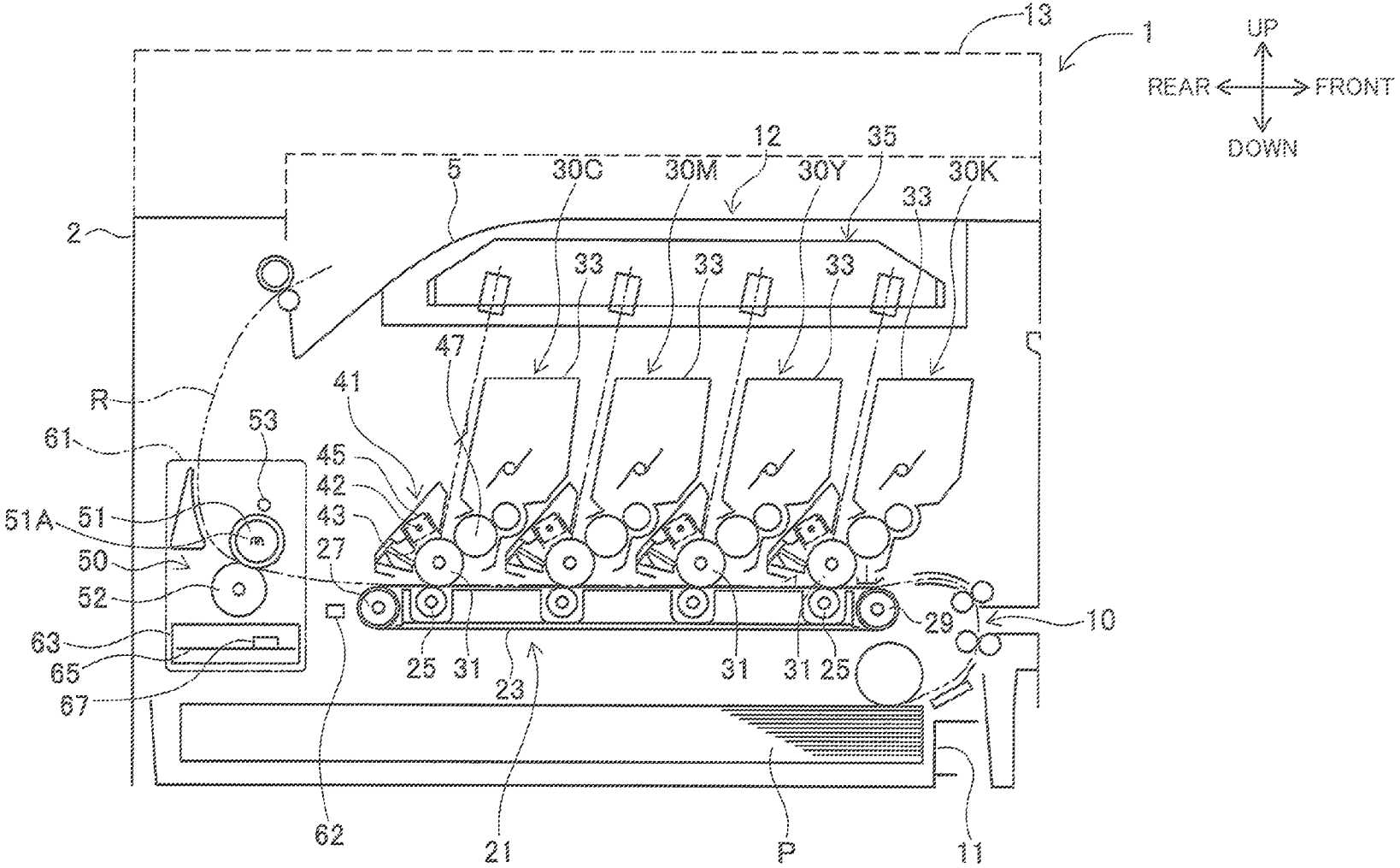
FIG. 1 is a cross-sectional view illustrating an overall configuration of a printer according to one embodiment.

Referring to the drawings, there will be hereinafter described one embodiment of the present disclosure. FIG. 1 is a view illustrating a simplified cross section of a printer 1 according to one embodiment as an image forming apparatus of the present disclosure. For instance, the printer 1 of the present embodiment is a multi-function peripheral (MFP) having a printing function, a copying function, a scanner function, and a facsimile (FAX) function. As illustrated in FIG. 1, the printer 1 includes a printing device 12, an image reader 13, a FAX communication device 15 (FIG. 2), a network interface 16 (FIG. 2), a user interface 17 (FIG. 2), and a controller 18 (FIG. 2).

Figure 2:
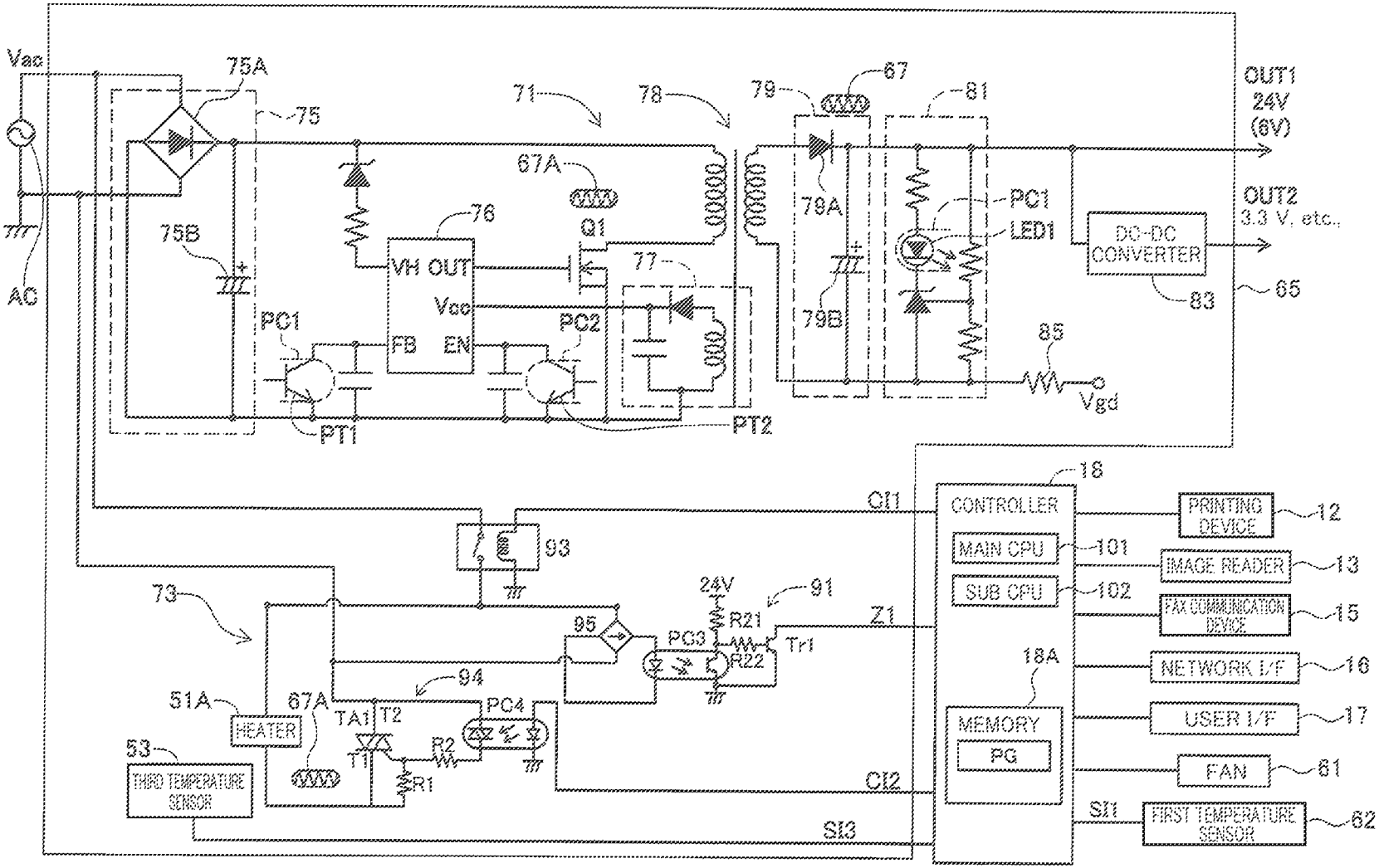
FIG. 2 is a view illustrating a circuit configuration of an AC/DC board and connection with a controller.

FIG. 2 illustrates connection between an AC/DC board 65 (which will be explained) of the printer 1 and the controller 18, etc. As illustrated in FIG. 2, the controller 18 is connected to the printing device 12, the image reader 13, the FAX communication device 15, the network interface 16, and the user interface 17, so as to control those devices.

The printer 1 of the present embodiment is a color laser printer, for instance. The printing device 12 is what is called tandem printing device configured to execute printing with toner of four colors. The printing device 12 forms a color image on a sheet (such as paper or OHP sheets) P according to an electrophotographic method under control of the controller 18. The printing device 12 is one example of an image forming device according to the present disclosure. The printing device 12 will be later explained in detail. The image forming device may be configured to execute printing according to an inkjet method, for instance, other than the electrophotographic method. In the following explanation, a right side and a left side in FIG. 1 are respectively defined as a front side and a rear side of the printer 1. A front side and a rear side of the sheet of FIG. 1 are respectively defined as a left side and a right side of the printer 1 when the printer 1 is viewed from the front side thereof. An upper side and a lower side in FIG. 1 are respectively defined as an upper side and a lower side of the printer 1.

As illustrated in FIG. 1, the printer 1 includes a generally box-like housing 2 in which are housed a sheet supplier 10, the printing device 12, and so on. An image reader 13 is provided on the housing 2. The image reader 13 includes a document table and an image sensor such as a contact image sensor (CIS) or a charge-coupled device (CCD). Under control of the controller 18 (FIG. 2), the image reader 13 moves the CIS with respect to a document placed on the document table and reads an image of the document to form image data.

The FAX communication device 15 illustrated in FIG. 2 is configured to transmit and receive FAX data to and from other facsimile machines over a telephone network under control of the controller 18. The network interface 16 is a LAN interface, for instance. The controller 18 receives image forming jobs such as a print job instructing printing, a scan job instructing scanning, and a FAX job instructing FAX transmission from a PC or the like connected to the LAN via the network interface 16. In the following explanation, the image forming job will be simply referred to as a job. For instance, the controller 18 controls the printing device 12 to execute printing based on the received print job. The user interface 17 is a touch panel, for instance, and contents displayed on a liquid crystal panel are changed under control of the controller 18. The user interface 17 outputs, to the controller 18, signals based on operational inputs by a user. For instance, the user interface 17 receives an instruction for executing a printing function, a copying function, FAX transmission function, or a scanning function. Accordingly, the controller 18 is capable of receiving jobs also through the user interface 17.

The way to receive various jobs such as the print job is not limited to that utilizing the network interface 16 and the user interface 17. The controller 18 may receive the jobs over wireless communication from a smartphone or the like. Further, based on connection with an external memory such as a USB memory, the controller 18 may receive a job for printing an image in the memory.

As illustrated in FIG. 1, a sheet-discharge tray 5 is disposed below the image reader 13 for storing a stack of the sheets P on which an image has been formed. The sheet supplier 10 includes various rollers and a sheet-supply tray 11 in which the sheets P are stored. The rollers are driven to supply each sheet P to the printing device 12. The sheet-supply tray 11 is detachable/attachable relative to a lower portion of the housing 2.

The printing device 12 includes a conveyor unit 21, four process cartridges 30C, 30M, 30Y, 30K, an exposure device 35, and a fixing device 50. The conveyor unit 21 is disposed between the sheet supplier 10 and the process cartridges 30C, etc., in the up-down direction. The conveyor unit 21 includes a conveyor belt 23 and four transfer rollers 25. The conveyor belt 23 is a loop-like endless belt and is looped over around a drive roller 27 located below a rear end portion of the printing device 12 and a driven roller 29 located below a front end portion of the printing device 12. The upper surface of the conveyor belt 23 extends substantially horizontally right under the process cartridges 30C, etc., so as to come into contact with a back surface of the sheet P supplied from the sheet supplier 10. The drive roller 27 causes the conveyor belt 23 to rotate in a predetermined direction. When a transfer bias is applied to the transfer rollers 25, the conveyor belt 23 is negatively charged so as to attract the sheet P to its upper surface by an electrostatic force. The conveyor belt 23 conveys the attracted sheet P toward the sheet-discharge tray 5 along a conveyance path R.

The four process cartridges 30C, 30M, 30Y, 30K respectively correspond to four colors, i.e., cyan (C), magenta (M), yellow (Y), and black (K). Each of the process cartridges 30C, etc., contains toner of a corresponding one of the four colors (C, M, Y, K). The four process cartridges 30K, 30Y, 30M, 30C are arranged in this order in a direction from the front side to the rear side of the printer 1.

The process cartridge 30C includes a photoconductive drum 31, a charging device 41, and a toner cartridge 33. The process cartridges 30M, 30Y, 30K differ from the process cartridge 30C in the color of toner but are identical with the process cartridge 30C in construction. In the following description, the process cartridge 30C is explained as a representative example, and an explanation of other process cartridges 30M, 30Y, 30K is dispensed with where appropriate.

The photoconductive drum 31 is disposed over the transfer roller 25 such that the conveyor belt 23 is sandwiched between the photoconductive drum 31 and the transfer roller 25 in the up-down direction. The charging device 41 is a scorotron charging device in which a charging wire 42 and a grid 43 are accommodated in a shield case 45. The shield case 45 has an opening formed at a portion thereof facing the photoconductive drum 31. The grid 43 is formed by conductive wires stretched in the form of a mesh at the opening of the shield case 45. The charging wire 42 is stretched in the shield case 45 to extend in the right-left direction. The charging wire 42 is disposed on an upper rear side of the photoconductive drum 31 with a spacing interposed therebetween. When an image is formed, the charging device 41 generates a corona discharge to positively charge the surface of the photoconductive drum 31 uniformly.

The exposure device 35 is disposed below the sheet-discharge tray 5. The exposure device 35 forms an electrostatic latent image based on the image data on the charged surface of each photoconductive drum 31. The toner contained in each toner cartridge 33 is carried on a surface of the corresponding developer roller 47 so as to be supplied to the surface of the corresponding photoconductive drum 31. The toner is supplied to the electrostatic latent image formed on the surface of each photoconductive drum 31, so that a toner image is formed. The conveyor unit 21 conveys the sheet P toward the fixing device 50, so that the toner image developed on the surface of each photoconductive drum 31 is transferred to the sheet P.

The fixing device 50 is disposed more downstream in the conveyance path R than the conveyor unit 21. The fixing device 50 includes a heating roller 51, a pressurizing roller 52, and a third temperature sensor 53. A heater 51A is provided in the heating roller 51. The heating roller 51 generates heat by energization to the heater 51A. The heater 51A is a halogen heater, for instance. The heating roller 51 is located on one of opposite sides of the sheet P that corresponds to the surface thereof on which an image is formed. The heating roller 51 rotates in synchronism with the conveyor belt 23, etc., so as to convey the sheet P while heating the toner transferred to the sheet P. The pressurizing roller 52 cooperates with the heating roller 51 to sandwich the sheet P therebetween and is driven and rotated while pressing the sheet P toward the heating roller 51. In this way, the fixing device 50 heats and melts the toner transferred to the sheet P to fix the toner onto the sheet P, and conveys the sheet P along the conveyance path R. The third temperature sensor 53 is a temperature detecting element for detecting a temperature of the heating roller 51. The third temperature sensor 53 is disposed near the heating roller 51. The controller 18 controls energization to the heater 51A of the heating roller 51 based on the detection temperature detected by the third temperature sensor 53. The third temperature sensor 53 and the heater 51A will be later explained in detail.

Figure 3:
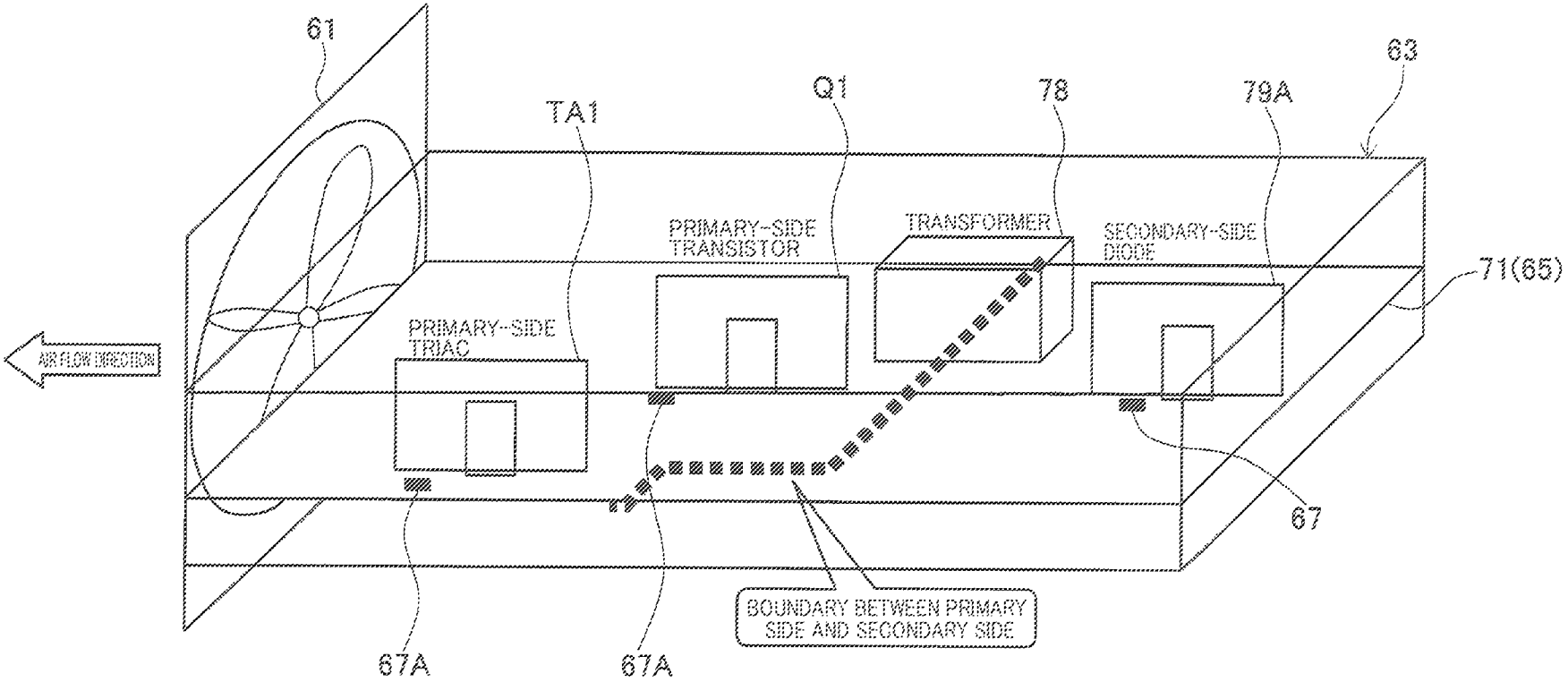
FIG. 3 is a schematic view illustrating configurations of an enclosure and a fan.

In the housing 2, a fan 61, a first temperature sensor 62, and an enclosure 63 are disposed. The fan 61 is disposed on the right side of the fixing device 50 (on the rear side of the sheet of FIG. 1). The fan 61 discharges the air in the housing 2 outside the housing 2 through an opening formed in the right side surface of the housing 2. The fan 61 has a plurality of blades that are rotated to discharge the air (FIG. 3). The controller 18 controls timing of starting to rotate the fan 61, a rotation speed of the fan 61, etc., so as to cool the interior of the housing 2. The controller 18 may control a rotation speed of a motor that rotates the fan 61. The position and the configuration of the fan 61 are described only by way of example. The fan 61 may be attached to a front surface or a rear surface of the housing 2, for instance. The fan 61 may be configured to feed the air into the housing 2. The fan 61 according to the present disclosure may be a heat sink that need not be rotated or a cooling device that utilizes water. In this instance, the controller 18 may control the cooling efficiency of the fan.

The first temperature sensor 62 is a temperature detecting element for detecting a temperature in the housing 2. The first temperature sensor 62 is disposed at a position at which a temperature of the toner cartridges 33 of the printing device 12 is detectable. Specifically, the first temperature sensor 62 is located between the fixing device 50 and the conveyor unit 21 in the front-rear direction so as to be attached to a left-side inner wall of the housing 2 (on the front side of the sheet of FIG. 1). The first temperature sensor 62 is disposed outside the enclosure 63 at a position at which the first temperature sensor 62 is farther from the heater 51A than the third temperature sensor 53 of the fixing device 50 is from the heater 51A. The first temperature sensor 62 outputs, to the controller 18 (FIG. 2), a first detection signal SI1 corresponding to a detection temperature in the housing 2 (hereinafter referred to as "first detection temperature" where appropriate).

The enclosure 63 is disposed below the fixing device 50. The enclosure 63 is shaped like a box and accommodates the AC/DC board 65. As later explained, the AC/DC board 65 includes an AC/DC circuit for converting an AC voltage supplied from the alternating current power source into a DC voltage and a second temperature sensor 67 for detecting a temperature of an element mounted on the board. Each of the first temperature sensor 62, the second temperature sensor 67, and the third temperature sensor 53 is a thermistor. Each of the first through third temperature sensors 62, 67, 53 may be a PTC thermistor or may be an NTC thermistor. The first temperature sensor 62 is one example of a first temperature detecting element, the second temperature sensor 67 is one example of a second temperature detecting element, and the third temperature sensor 53 is one example of a third temperature detecting element. It is noted that the temperature detecting elements according to the present disclosure are not limited to the thermistors. The temperature detecting elements may be other elements capable of detecting the temperature such as thermocouples and semiconductor temperature sensors.

The locations of the first through third temperature sensors 62, 67, 53 are described only by way of example. For instance, the first temperature sensor 62 may be disposed near the process cartridge 30K containing black toner, may be disposed above the toner cartridge 33, or may be disposed below the conveyor unit 21. The second temperature sensor 67 may be disposed above the AC/DC board 65 or may be attached to an inner wall of the enclosure 63. The third temperature sensor 53 may be disposed in the heating roller 51.

2. Configurations of AC/DC Board 65 and Controller 18

As illustrated in FIG. 2, the AC/DC board 65 includes an AC/DC circuit 71 and a heater control circuit 73. The AC/DC circuit 71 and the heater control circuit 73 may be mutually separate boards. The AC/DC board 65 is connected to the controller 18. The controller 18 includes a main CPU 101, a sub CPU 102, and a memory 18A. The main CPU 101 executes a control program PG stored in the memory 18A to control the devices such as the printing device 12 and the fan 61. As later explained, the sub CPU 102 monitors a status of the printer 1 in a specific mode (e.g., a deep sleep mode) of the printer 1. The controller according to the present disclosure is not limited to the configuration in which the CPU executes the program. The controller may be constituted by at least one hardware circuit such as an ASIC. The controller may be constituted by a combination of a processing circuit for software processing executed by the CPU and a hardware circuit. In the following explanation, the controller 18 that executes the control program PG is represented concretely by a device name where appropriate. For instance, a description that "the controller 18 executes a control based on the detection temperature of the first temperature sensor 62" sometimes means that "the main CPU 101 executes the control program PG, whereby the controller 18 executes a control based on the detection temperature of the first temperature sensor 62".

As illustrated in FIG. 2, the AC/DC circuit 71 includes a rectifying and smoothing circuit 75, a control IC 76, a voltage generating circuit 77, a transformer 78, a transistor Q1, a rectifying and smoothing circuit 79, a voltage detecting circuit 81, and a DC-DC converter 83. The AC/DC circuit 71 rectifies and smoothes an AC voltage Vac of the alternating current power source AC to generate a DC voltage (e.g., a DC voltage of 24 V or 3.3 V) required in the printer 1.

The rectifying and smoothing circuit 75 is of a capacitor input type. The rectifying and smoothing circuit 75 is constructed such that a bridge diode 75A for rectifying the AC voltage Vac of the alternating current power source AC is connected to a capacitor 75B for smoothing the rectified voltage. The alternating current power source AC is a commercial power source for supplying the AC voltage Vac of 100 V or 200 V, for instance. The output of the rectifying and smoothing circuit 75 is applied to a primary coil of the transformer 78. The transformer 78 in the present embodiment is a step-down transformer for lowering the AC voltage Vac. The AC/DC board 65 may include a step-up transformer or may include both the step-down transformer and the step-up transformer.

The transistor Q1 switches an electric current that is supplied to the transformer 78. The transistor Q1 is an N-channel MOSFET, for instance. By an on-off signal (PWM signal) supplied to a gate terminal of the transistor Q1 from an output port OUT of the control IC 76, the transistor Q1 turns on and off. Thus, the primary side of the transformer 78 oscillates so as to induce a voltage in a secondary coil of the transformer 78.

The voltage generating circuit 77 is provided on the primary side of the transformer 78. The voltage generating circuit 77 rectifies, by a diode, a voltage induced in an auxiliary coil provided on the primary side of the transformer 78 and smoothes the rectified voltage by a capacitor, so as to supply a source voltage Vcc to the control IC 76. The source voltage is supplied to an input port VH of the control IC 76 on startup of the AC/DC circuit 71.

The rectifying and smoothing circuit 79 includes a diode 79A for rectifying the voltage induced in the secondary coil of the transformer 78 and a capacitor 79B for smoothing the rectified voltage, so as to generate a DC voltage. The rectifying and smoothing circuit 79 generates a DC voltage of 24 V or 6 V, for instance. The DC-DC converter 83 converts the DC voltage of 24 V or 6 V that is input from the rectifying and smoothing circuit 79 via the voltage detecting circuit 81 into the DC voltage of 3.3 V for driving the controller 18, the source voltage Vcc2 (FIG. 5) for the followability information and the second temperature sensor 67, etc., so as to output the converted voltage therefrom. The voltage values in FIG. 2 are illustrated only by way of example.

The voltage detecting circuit 81 includes a photocoupler PC1 and causes a light emitting diode LED1 of the photocoupler PC1 to illuminate in accordance with a detection level of the 24 V output of the AC/DC circuit 71. The photocoupler PC1 includes a phototransistor PT1 connected to a feedback port FB of the control IC 76. In this configuration, a photo signal of the light emitting diode LED1 is converted back to an electric signal by the phototransistor PT1, and the detection value of the 24 V output is fed back to the feedback port FB of the control IC 76. The control IC 76 controls ON/OFF of the transistor Q1 in accordance with the fed-back electric signal.

On the secondary side of the AC/DC circuit 71, a sensing resistor 85, which is for detecting an overcurrent that flows through the transformer 78, is connected to a ground side. When an overcurrent not lower than a predetermined current value flows in the sensing resistor 85 through the ground, for instance, the control IC 76 is notified of the fact via a photocoupler not shown. Upon the generation of the overcurrent, the control IC 76 turns off the transistor Q1 to stop energization to the transformer 78, for instance.

A phototransistor PT2 that constitutes a photocoupler PC2 is connected to a control input port EN of the control IC 76. The photocoupler PC2 is constituted by the phototransistor PT2 and a light emitting diode (not shown) connected to the controller 18. In this configuration, the control signal from the controller 18 is input to the control IC 76 via the photocoupler PC2. The control IC 76 controls the on-off signal output from the output port OUT to the transistor Q1 based on the control signal input to the control input port EN from the controller 18, so as to control the oscillation of the primary side of the transformer 78. The control IC 76 executes conversion of the output voltage (24 V, 6 V) so as to correspond to an operation mode of the printer 1 (that will be explained), based on the control signal from the controller 18.

The heater control circuit 73 is connected to the heater 51A and includes a zero crossing detector circuit 91, a relay 93, and an energizing circuit 94. The heater 51A generates heat in accordance with energization by the alternating current power source AC. The third temperature sensor 53 outputs, to the controller 18, a third detection signal SI3 corresponding to a detected temperature of the heater 51A (hereinafter referred to as "third detection temperature" where appropriate).

The relay 93 switches whether or not to electrically connect the alternating current power source AC and the heater 51A, based on a relay control signal CI1 output from the controller 18. The zero crossing detector circuit 91 includes a diode bridge 95, a photocoupler PC3, resistors R21, R22, and a transistor Tr1 that is an NPN bipolar transistor. The zero crossing detector circuit 91 outputs, to the controller 18, a zero crossing signal Z1 that is a pulse signal corresponding to zero crossing timing of the alternating current power source AC. The zero crossing timing is timing at which the alternating current is 0. Based on the zero crossing signal Z1, the controller 18 changes a heater control signal CI2 for controlling energization to the heater 51A.

The energizing circuit 94 includes a triac TA1, a phototriac coupler PC4, and resistors R1, R2. A T2 terminal of the triac TA1 is connected to one pole of the alternating current power source AC, and a T1 terminal thereof is connected to the other pole of the alternating current power source AC via the heater 51A and the relay 93. A gate terminal of the triac TA1 is connected to the T1 terminal via the resistor R1. Further, the gate terminal of the triac TA1 is connected to the T2 terminal via the resistor R2 and a triac of the phototriac coupler PC4. The heater control signal CI2 is input from the controller 18 to an anode terminal of an LED of the phototriac coupler PC4. A cathode terminal of the LED of the phototriac coupler PC4 is grounded. Based on the zero crossing signal Z1, the third detection signal SI3 of the third temperature sensor 53, the target temperature, etc., the controller 18 changes the heater control signal CI2 and switches turn-on and turn-off of the triac TA1, so as to control energization to the heater 51A, namely, ON/OFF of the heater 51A.

3. Location of Second Temperature Sensor 67

Next, there will be explained a location of the second temperature sensor 67. FIG. 3 schematically illustrates the enclosure 63 and the fan 61. As illustrated in FIG. 3, the AC/DC circuit 71 of the AC/DC board 65 is fixed in the box-like enclosure 63. The fan 61 is disposed near the side surface of the board that is located on the primary side (high-voltage side) of the transformer 78 in the AC/DC circuit 71. The fan 61 causes the air in the housing 2 to flow from the right side to the left side in FIG. 3, namely, from the secondary side (low-voltage side) to the primary side in the AC/DC circuit 71.

The second temperature sensor 67 according to the present embodiment is disposed at a position at which a temperature of the rectifying diode 79A on the secondary side is detectable. The diode 79A is one example of the element mounted on the AC/DC board. The second temperature sensor 67 is disposed at a position distant from the diode 79A by a predetermined distance and is mounted on the AC/DC board 65. The controller 18 of the present embodiment executes processings of FIG. 6, etc., so as to control the fan 61 based on comparisons between the detection temperatures by the first and second temperature sensors 62, 67 and thresholds (such as a first temperature threshold TH1A).

The location of the second temperature sensor 67 is described only by way of example. The second temperature sensor 67 may be disposed near other element that is mounted on the AC/DC board 65 and that is likely to generate heat. As illustrated in FIGS. 2 and 3, a second temperature sensor 67A may be disposed near the transistor Q1 that performs switching of energization to the primary side of the transformer 78. The second temperature sensor 67A may be disposed near the triac TA1 that performs switching of energization to the heater 51A.

A plurality of the second temperature sensors 67 may be disposed. For instance, both the second temperature sensor 67 for the diode 79A on the secondary side and the second temperature sensor 67A for the transistor Q1 on the primary side may be provided, and the controller 18 may be configured to compare the detection temperatures by the two second temperature sensors 67, 67A with thresholds to control the fan 61. A plurality of the second temperature sensors 67 may be provided for one of the primary side and the secondary side. For instance, the second temperature sensor 67 may be provided for each of the diode 79A and the sensing resistor 85 on the secondary side. Further, the second temperature sensor 67A may be provided for each of the transistor Q1 and the triac TA1 on the primary side.

4. Fan Control Utilizing Thresholds and Followability Information

The controller 18 according to the present embodiment controls the fan 61 by comparing the detection temperatures detected by the first temperature sensor 62 and the second temperature sensor 67 with the thresholds. FIG. 4 is a table showing a relationship between control details for controlling the fan 61 and the thresholds. In the table of FIG. 4, a kind of the temperature sensor, an operation of the fan, a threshold name, a manufacturer 1, a manufacturer 2, and remarks indicating concrete control details are listed in this order from the left. In the present embodiment, as illustrated in FIG. 4, there are set first temperature thresholds TH1A, TH2A, TH3A, TH4A and print control thresholds TP1, TP2 each as a threshold to be compared with the first detection temperature T1 by the first temperature sensor 62, and there are set second temperature thresholds TH1B, TH2B, TH3B, TH4B each as a threshold to be compared with the second detection temperature T2 by the second temperature sensor 67. The memory 18A of the controller 18 stores information on thresholds of FIG. 4.

The controller 18 of the present embodiment is configured to switch a rotation speed (hereinafter simply referred to as "speed" where appropriate) of the fan 61 in three steps, i.e., OFF (stop) state, a half speed, and a full speed. At the half speed, the fan 61 is rotated at a speed half the full speed, for instance. The controller 18 causes the fan 61 to rotate at the half speed when the first detection temperature T1 detected by the first temperature sensor 62 increases to not less than the first temperature threshold TH1A. The controller 18 causes the fan 61 to rotate at the half speed when the second detection temperature T2 detected by the second temperature sensor 67 increases to not less than the second temperature threshold TH1B. The controller 18 causes the fan 61 to rotate at the half speed when at least one of the above two conditions (T1≥TH1A, T2≥TH1B) is satisfied. Similarly, the controller 18 causes the fan 61 to rotate at the full speed when at least one of: a condition in which the first detection temperature T1 increases to not less than the first temperature threshold TH2A: and a condition in which the second detection temperature T2 increases to not less than the second temperature threshold TH2B is satisfied.

Even if the first detection temperature T1 becomes not greater than the first temperature threshold TH3A, the controller 18 keeps rotating the fan 61 at the full speed unless the second detection temperature T2 becomes not greater than the second temperature threshold TH3B. Accordingly, the controller 18 gives a higher priority to one of the determination results respectively utilizing the first detection temperature T1 and the second detection temperature T2, which one of the determination results instructs rotating the fan 61 at a higher speed.

As illustrated in FIG. 4, among the second temperature thresholds TH1B-TH4B, the second temperature threshold TH1B (75° C.) for switching the rotation speed of the fan 61 from the OFF (stop state) to the half speed differs from the second temperature threshold TH4B (70° C.) for switching the rotation speed from the half speed to the OFF. That is, regarding the thresholds for switching the rotation speed between mutually different speeds, the threshold for increasing the speed is made lower than the threshold for decreasing the speed, to establish a hysteresis relationship in the temperature thresholds. In this respect, a case is considered in which the second temperature thresholds TH1B, TH4B take mutually the same value. In this case, if a noise occurs in a signal path of the second detection signal SI2 of the second temperature sensor 67, the second detection temperature may frequently cross the second temperature thresholds TH1B, TH4B, undesirably causing frequent switching between the OFF (stop state) and the half speed. By setting mutually different values for the second temperature thresholds TH1B, TH4B as described above, it is possible to prevent frequent switchover of the speed. This is true of the second temperature thresholds TH2B, TH3B for switching between the half speed and the full speed. The second temperature thresholds TH1B, TH4B may take mutually the same value. The second temperature threshold TH4B may be higher than the second temperature threshold TH1B. Like the second temperature thresholds TH1B-TH4B, the first temperature thresholds TH1A-TH4A of the first temperature sensor 62 may be set to establish a hysteresis relationship in the temperature thresholds.

The control details are described only by way of example. The controller 18 may change the speed of the fan 61 in two steps such as the OFF and the full speed or in four or more steps such as the OFF, a low speed, a middle speed, and a high speed. The controller 18 may cause the fan 61 to rotate at the half speed when the two conditions (T1≥TH1A, T2≥TH1B) relating to the first and second detection temperatures T1, T2 are satisfied.

During execution of a printing process, the controller 18 suspends or restarts printing depending on the first detection temperature T1. Specifically, when the first detection temperature T1 becomes not less than the print control threshold TP1, the controller 18 suspends (stops) the printing process being currently performed while rotating the fan 61 at the full speed, irrespective of the second detection temperature T2. Further, when the first detection temperature T1 becomes not greater than the print control threshold TP2, the controller 18 restarts the suspended printing process while rotating the fan 61 at the full speed, irrespective of the second detection temperature T2. In this configuration, when the temperature in the housing 2 becomes not less than the predetermined print control threshold TP1, the printing is suspended to prevent a temperature rise, thus preventing or reducing an occurrence of a failure of the printing device 12, etc. In this respect, as executed for the printing process, there may be executed a control of suspending the scan process or the FAX communication process that is being currently executed, based on an increase in the first detection temperature T1.

The followability of the first temperature sensor 62 or the second temperature sensor 67 with respect to the temperature of the element, as a target whose temperature is to be detected (hereinafter referred to as "detection target element" where appropriate), varies due to various factors. Here, the followability is a degree to which a change in the detection temperature detected by the second temperature sensor 67 is delayed with respect to an actual temperature change of the diode 79A as the detection target, for instance. Alternatively, the followability is accuracy of the detection temperature with respect to an actual temperature, for instance. As explained above, the controller 18 controls the fan 61 based on comparison between the first and second detection temperatures T1, T2 and the thresholds. In a case where the delay or the error is large and the followability is accordingly low, the control of the fan 61 based on the detection temperature suffers from a delay or the like. The controller 18 of the present embodiment therefore sets the threshold when the followability is low so as to be lower than the threshold when the followability is high. In this configuration, the fan 61 is rotated at an early stage even when the followability is low, thus preventing the temperature in the housing 2 from being increased.

The degree of the followability varies due to various factors. FIG. 4 illustrates a case in which a difference in the degree of the followability is generated because the AC/DC board 65 is manufactured by two different manufacturers. Specifically, the followability varies due to a size of a heat sink with which the detection target element (such as the diode 79A) of the second temperature sensor 67 is in contact, a physical distance between the detection target element and the second temperature sensor 67, a difference in the resistor value of a sensing resistor Rdown (FIG. 5) connected to the second temperature sensor 67, a circuit constant of the AC/DC board 65, and so on. These conditions differ between the two manufacturers 1, 2 illustrated in FIG. 4. Consequently, the followability of the manufacturer 1 is lower than the followability of the manufacturer 2. Accordingly, the second temperature thresholds TH1B-TH4B of the manufacturer 1 are set so as to be lower than those of the manufacturer 2, as illustrated in FIG. 4.

In the example of FIG. 4, only the second temperature thresholds TH1B-TH4B are different between the two manufacturers 1, 2 in consideration of the followability, and the first temperature thresholds TH1A-TH4A are the same between the two manufacturers 1, 2. Like the second temperature thresholds TH1B-TH4B, the first temperature thresholds TH1A-TH4A may be different between the two manufacturers 1, 2 in consideration of the followability. For instance, the first temperature thresholds TH1A-TH4A may be different between the two manufacturers 1, 2 depending on a manufacturer of the first temperature sensor 62, a circuit constant of a circuit to which the first temperature sensor 62 is connected, etc. Further, the second temperature thresholds TH1B-TH4B may be the same between the two manufacturers 1, 2 whereas the first temperature thresholds TH1A-TH4A may be different therebetween in consideration of the followability.

In the example of FIG. 4, a subject that is changed based on the followability is not limited to the temperature threshold. For instance, the controller 18 may correct voltage values of detection voltages detected by the second temperature sensor 67 or the detection temperature values detected by the second temperature sensor 67, in accordance with the degree of the followability. The controller 18 may change a table for converting the detection voltages into the detection temperatures in accordance with the degree of the followability. The controller 18 may change a resistor value of a variable resistor connected to the second temperature sensor 67 in accordance with the degree of the followability.

Figure 5:
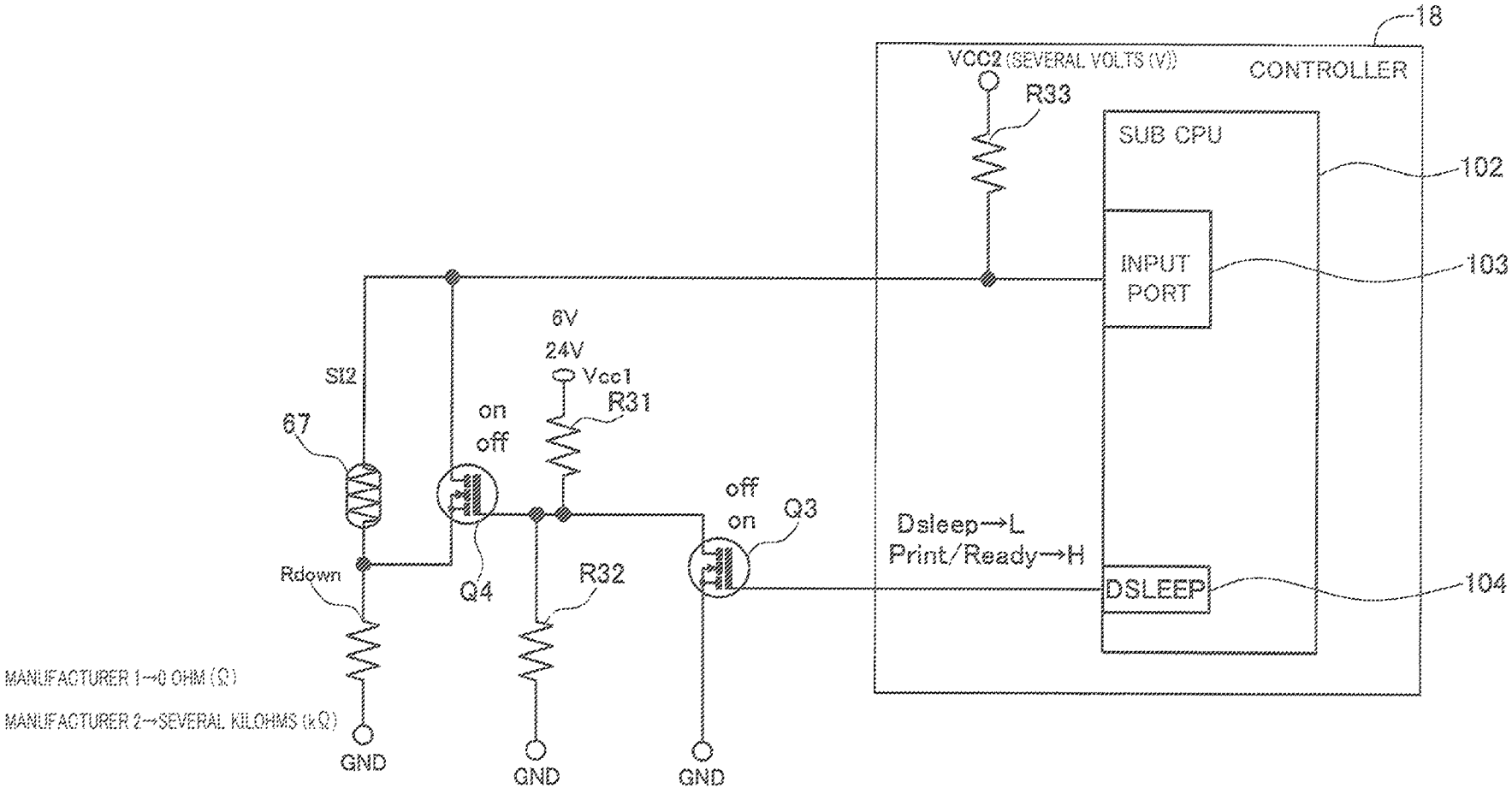
FIG. 5 is a circuit diagram illustrating connection between a second temperature sensor and the controller.

There will be next explained a method according to which the controller 18 obtains followability information that is information on the followability. FIG. 5 illustrates connection between the controller 18 and the second temperature sensor 67. The controller 18 of the present embodiment utilizes a port connected to the second temperature sensor 67 as a port for inputting the followability information. Specifically, the sub CPU 102 of the controller 18 includes two ports 103, 104, as illustrated in FIG. 5. The port 103 is connected to the second temperature sensor 67, and the second detection signal SI2 corresponding to the voltage generated in the second temperature sensor 67 is inputted to the port 103.

The controller 18 outputs, from the port 104, a high-level signal or a low-level signal in accordance with the operation mode of the printer 1. As the operation mode, a ready mode, a print mode, and a deep sleep mode are set for the printer 1 of the present embodiment. The ready mode is a mode in which the printer 1 is ready to execute the printing process or the like immediately in response to a job such as the print job. The print mode is a mode in which the printing device 12 is operated to execute the printing process. In the ready mode and the print mode, the AC/DC board 65 supplies the output voltage of 24 V to the devices of the printer 1. The AC/DC board 65 supplies the output voltage of 24 V to the devices of the printer 1 also in a scan mode in which the image reader 13 executes the scan process and in a FAX mode in which the FAX communication device 15 executes the FAX communication.

The deep sleep mode is a mode prior to shifting to the ready mode or the print mode after the printer 1 is turned on. The deep sleep mode may be referred to as a power saving mode for reducing power consumption of the printer 1 more than in the ready mode and the print mode. At the time of startup at which the printer 1 is turned on, the printer 1 boots up in the deep sleep mode and then shifts to the ready mode or the print mode. In a case where the execution request for executing the print job is not made for a predetermined length of time after shifting from the print mode to the ready mode upon completion of the printing process, the printer 1 shifts to the deep sleep mode. In the deep sleep mode, the printer 1 stops energization to the heater 51A of the fixing device 50 and turns off a backlight of the liquid crystal panel of the user interface 17. Further, in the deep sleep mode, only part of the AC/DC board 65 operates, and the output voltage is accordingly lowered from 24 V to 6 V (FIG. 2). At the time of startup of the printer 1, the main CPU 101 boots up in the deep sleep mode, and the printer 1 then shifts to the ready mode, etc. After shifting from the ready mode to the deep sleep mode, the printer 1 shift to the print mode, etc., when the input operation to the user interface 17 or the like is received in the deep sleep mode or when the print job is received from the PC via the network interface 16 in the deep sleep mode.

In the deep sleep mode at the time of startup of the printer 1, the printer 1 boots up from its stopping state. Accordingly, the temperature in the housing 2 and the temperature of the AC/DC board 65 do not yet rise. In other words, it is not required for the controller 18 to monitor the temperature in the housing 2 with the first and second temperature sensors 62, 67 and drive the fan 61. Accordingly, the controller 18 utilizes, in the deep sleep mode at the time of startup of the printer 1, the port 103 connected to the second temperature sensor 67 as the input port to which the followability information is input. After the startup, the controller 18 utilizes the port 103 as the port to which the second detection signal SI2 of the second temperature sensor 67 is input. The followability information may be input through the port 103 not only in the deep sleep mode at the time of startup but also after shifting from the ready mode to the deep sleep mode after the startup. As illustrated in FIG. 5, the port 104 of the sub CPU 102 is connected to a gate terminal of an N-channel MOSFET transistor Q3. A source terminal of the transistor Q3 is connected to the ground, and a drain terminal of the transistor Q3 is connected to a gate terminal of an N-channel MOSFET transistor Q4. There is input, to the gate terminal of the transistor Q4, a voltage divided by a resistor R31 connected to a source voltage Vcc1 and a resistor R32 connected to the ground. The voltage of 6 V is supplied as the source voltage Vcc1 in the deep sleep mode, and the voltage of 24 V is supplied as the source voltage Vcc1 in the print mode and the ready mode, for instance. In FIG. 5, the signal level of the port 104, the ON/OFF state of the transistors Q3, Q4, the voltage value of the source voltage Vcc in the deep sleep mode, and the voltage value of the source voltage Vcc in the print mode and the ready mode are illustrated in association with one another.

A source terminal of the transistor Q4 is connected to the ground via the sensing resistor Rdown, and a drain terminal of the transistor Q4 is connected to the port 103. One and the other ends of the second temperature sensor 67 are respectively connected to the drain terminal and the source terminal of the transistor Q4. Thus, the second temperature sensor 67 and the transistor Q4 are parallelly connected to the port 103. A source voltage Vcc2 is connected to the port 103 via a resistor R33. The source voltage Vcc2 supplies a constant voltage (e.g., several volts) irrespective of the operation mode.

As illustrated in FIG. 5, the sub CPU 102 sets the signal output from the port 104 to an L (Low) level in the deep sleep mode and to an H (High) level in the mode in which power saving is not intended, such as the print mode or the ready mode. When the transistor Q3 turns off in the deep sleep mode, the high-level signal is input to the gate terminal of the transistor Q4. When the transistor Q4 turns on, both ends of the second temperature sensor 67 are short-circuited by the transistor Q4 and the voltage divided by the sensing resistor Rdown and the resistor R33 is input to the port 103.

The resistor value of the sensing resistor Rdown differs between the manufacturers of the AC/DC board 65 illustrated in FIG. 4, for instance. For instance, the resistor value of the sensing resistor Rdown of the manufacturer 1 is 0 ohm (Ω) while the resistor value of the sensing resistor Rdown of the manufacturer 2 is several kilohms (kΩ). In the case of the manufacturer 1, the voltage of the ground level is input to the port 103. In the case of the manufacturer 2, there are input, to the port 103, the voltage based on the resistor values of the sensing resistor Rdown and the resistor R33 and the voltage value of the source voltage Vcc2. In this configuration, the sub CPU 102 can detect, in the deep sleep mode, the manufacturer of the AC/DC board 65 installed on the printer 1 based on the voltage value input from the port 103. The controller 18 reads out the thresholds set in accordance with the type of the detected manufacturer from the memory 18A and sets the thresholds (FIG. 4).

The sub CPU 102 outputs the H-level signal from the port 104 in the ready mode and the print mode. When the transistor Q3 turns on, the transistor Q4 turns off. In the state in which the printing or the like is executed, namely, in a state in which the temperature of the element mounted on the AC/DC board 65 needs to be detected, the voltage value corresponding to the voltage generated in the second temperature sensor 67 is input to the port 103. Based on the voltage value input to the port 103, the controller 18 judges the detection temperature by the second temperature sensor 67.

The followability information in the present disclosure is not limited to the information on the manufacturers. Here, a case is considered in which the AC/DC board 65 is connected to the alternating current power source AC of the 100 V system. When the temperature of the transistor Q1 on the primary side is desired to be estimated by the second temperature sensor 67 on the secondary side, there is a possibility that the followability with respect to an actual temperature of the transistor Q1 is lowered. In this instance, the controller 18 may obtain, as the followability information, information as to whether the AC/DC board 65 is connected to the alternating current power source AC of the 100 V system or the alternating current power source AC of the 200 V system and may change the thresholds. Specifically, when the AC/DC board 65 is connected to the 100 V system and the temperature of the transistor Q1 on the primary side is estimated, the controller 18 may determine, based on the followability information, that the followability is low and may set the thresholds so as to be lower.

5. Fan Control

Referring next to FIGS. 6-9, there will be explained the control of the fan 61 executed by the controller 18. FIGS. 6-9 indicate details of a fan control processing executed by the controller 18. When the printer 1 is turned on, the controller 18 starts the processing illustrated in FIGS. 6-9. Among the jobs executed in the printer 1, the print job for executing printing is explained below. The controller 18 is capable of executing a control of the fan 61 for the scan job and the FAX job similarly to the control of the fan 61 for the print job explained below.

Figure 6:
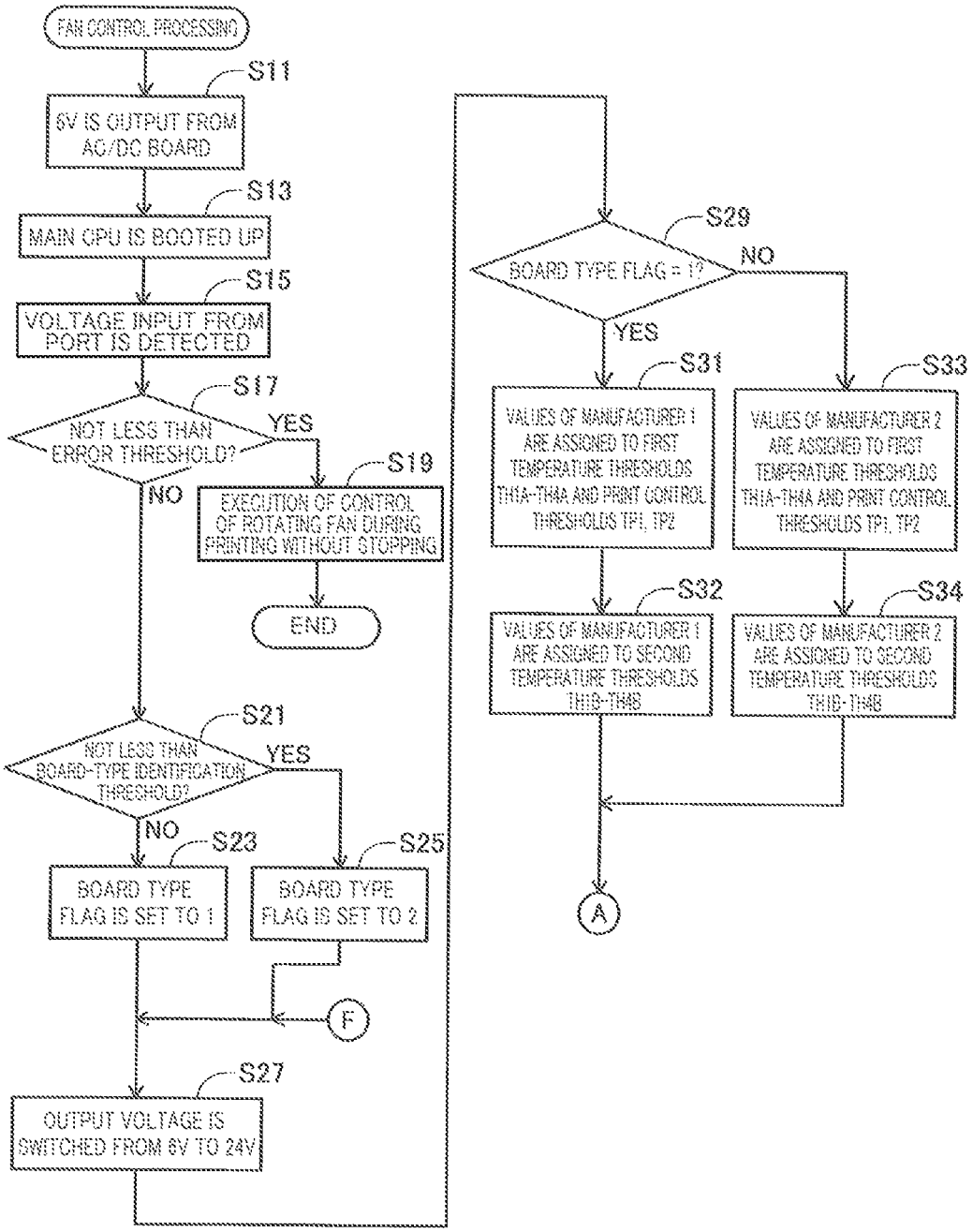
FIG. 6 is a part of a flowchart representing a fan control processing.

When the printer 1 is turned on, the controller 18 executes, at Step 11 in FIG. 6, a control in the deep sleep mode. (Hereinafter, Step 11 will be abbreviated as "S11". Other steps will be similarly abbreviated.) For instance, the sub CPU 102 of the controller 18 controls the output voltage of the AC/DC circuit 71 of the AC/DC board 65 to 6 V.

The controller 18 boots up the main CPU 101 (S13). For instance, the controller 18 supplies, to the main CPU 101, the voltage of 3.3 V input from the AC/DC circuit 71 so as to boot up the main CPU 101. The controller 18 detects a voltage input from the port 103 (S15). Because the printer 1 is in the deep sleep mode at this time point, the sub CPU 102 outputs the L-level signal from the port 104. Accordingly, the voltage corresponding to the resistor value of the sensing resistor Rdown is input to the port 103.

The controller 18 makes a determination as to the voltage value input from the port 103 at S15 (S17). As explained above, the voltage value of the ground level is input to the port 103 in the case of the manufacturer 1, and the voltage value based on the resistor value of the sensing resistor Rdown is input to the port 103 in the case of the manufacturer 2. In a case where an abnormality such as a short circuit or the like occurs in a connection circuit of the sensing resistor Rdown, a voltage value more than expected by the manufacturer 2, namely, an abnormal voltage value, may be input to the port 103. In view of this, the controller 18 determines at S17 whether the voltage value input from the port 103 is not less than a predetermined threshold for determining an occurrence of an error.

When the voltage value input from the port 103 is not less than the error threshold (S17: YES), the controller 18 executes a control of rotating the fan 61 during printing without stopping (S19). The controller 18 ends the processing illustrated in FIGS. 6-9. When printing is executed after execution of S19, the controller 18 causes the fan 61 to rotate at the full speed without stopping. In this configuration, in a case where the information on the manufacturer of the AC/DC board 65 cannot be normally obtained, the fan 61 is surely rotated during printing to thereby obviate a temperature rise in the housing 2. The controller 18 may notify, as an error, a failure in which the resistor value of the sensing resistor Rdown cannot be properly detected or a failure in which the manufacturer cannot be identified. The controller 18 may rotate the fan 61 at the full speed without stopping during printing or the like until the printer 1 is turned off. In a case where the controller 18 can identify the manufacturer by again detecting the resistor value of the sensing resistor Rdown upon next turn-on of the printer 1 or upon shifting to the deep sleep mode, the controller 18 may resume the control of the fan 61 based on the first temperature thresholds TH1A-TH4A, etc.

On the other hand, when the voltage value input from the port 103 is less than the error threshold (S17: NO), the controller 18 determines whether the voltage value input from the port 103 is not less than a board-type identification threshold (S21). The board-type identification threshold is a threshold for identifying whether the manufacturer of the AC/DC board 65 is the manufacturer 1 or the manufacturer 2. For instance, the board-type identification threshold is a voltage value for determining whether the voltage value input from the port 103 is a voltage corresponding to the resistor value (several kilohms (kΩ)) of the sensing resistor Rdown of the manufacturer 2. When the voltage value input from the port 103 is less than the board-type identification threshold (S21: NO), namely, the AC/DC board 65 is manufactured by the manufacturer 1, the controller 18 sets a board type flag to "1" (S23). On the other hand, when the voltage value input from the port 103 is not less than the board-type identification threshold (S21: YES), namely, when the AC/DC board 65 is manufactured by the manufacturer 2, the controller 18 sets the board type flag to "2" (S25). The board type flag is stored in the memory 18A of the controller 18, for instance.

After executing S23 or S25, the controller 18 switches the output voltage of the AC/DC board 65 from 6 V to 24 V (S27). For instance, the controller 18 controls the control IC 76 by the phototransistor PT2 (FIG. 2) to change the output voltage of the AC/DC board 65. In a case where the print job is not received, the controller 18 causes the printer 1 to shift from the deep sleep mode to the ready mode, so as to place the printer 1 in a standby state for receiving the print job (S27). In a case where the print job is received, the controller 18 causes the printer 1 to shift from the deep sleep mode to the print mode, so as to execute the print job (S27).

After executing S27, the controller 18 executes S29 and subsequent steps. That is, the controller 18 sets the first temperature thresholds TH1A-TH4A, the print control thresholds TP1, TP2, and the second temperature thresholds TH1B-TH4B in accordance with the board type flag, namely, in accordance with the manufacturer of the AC/DC board 65. Specifically, the controller 18 determines at S29 whether the board type flag is "1". When the board type flag is "1" (S29: YES), the controller 18 executes S31, S32 to assign the values of the manufacturer 1 (FIG. 4) to the first temperature thresholds TH1A-TH4A, the print control thresholds TP1, TP2, and the second temperature thresholds TH1B-TH4B. When the board type flag is "2" (S29: NO), the controller 18 executes S33, S34 to assign the values of the manufacturer 2 (FIG. 4) to the first temperature thresholds TH1A-TH4A, the print control thresholds TP1, TP2, and the second temperature thresholds TH1B-TH4B. With this configuration, the controller 18 can set the thresholds that correspond to the manufacturer of the AC/DC board 65, namely, the thresholds that correspond to the followability information. After executing S32 or S34, the controller 18 executes S35 in FIG. 7.

At S35 and subsequent steps, the controller 18 sets a FAN flag for determining the rotation speed of the fan 61 and controls the fan 61 based on the set FAN flag. The FAN flag is stored in the memory 18A. There are set, for the FAN flag, values that can identify the three steps, i.e., the OFF (stop), the half speed, and the full speed.

At S35, the controller 18 determines whether the FAN flag indicates the OFF. The FAN flag is set to a value indicative of the OFF as an initial value at the time of startup. Accordingly, the controller 18 makes an affirmative determination at S35 (S35: YES) and subsequently executes S37. The controller 18 obtains the voltage value of the first temperature sensor 62 (S37) and determines whether the first detection temperature T1 indicated by the obtained voltage value is not less than the first temperature threshold TH1A (S39).

When the first detection temperature T1 is not less than the first temperature threshold TH1A (S39: YES), the controller 18 sets the FAN flag to the half speed (S41). When the first detection temperature T1 is less than the first temperature threshold TH1A (S39: NO), on the other hand, the controller 18 obtains the voltage value of the second temperature sensor 67 (S43) and subsequently executes S45. At S45, the controller 18 determines whether the second detection temperature T2 indicated by the voltage value obtained from the second temperature sensor 67 is not less than the second temperature threshold TH1B.

When the second detection temperature T2 is not less than the second temperature threshold TH1B (S45: YES), the controller 18 sets the FAN flag to the half speed (S41). After executing S41, the controller 18 executes S47 in FIG. 9. Thus, the controller 18 causes the fan 61 to rotate at the half speed when one of the two conditions is satisfied, the two conditions relating to the first and second temperature thresholds TH1A, TH1B for determining whether the rotation speed is changed from the OFF to the half speed.

When the second detection temperature T2 is less than the second temperature threshold TH1B (S45: NO), the controller 18 executes S47 without changing the FAN flag. In this instance, the FAN flag is kept set at the OFF. The controller 18 may compare the voltage values of the first temperature sensor 62 and the second temperature sensor 67 with the thresholds without converting the voltage values into the first and second detection temperatures T1, T2. For instance, the controller 18 may set, as the threshold, the voltage value corresponding to the first temperature threshold TH1A and may compare the voltage value of the first temperature sensor 62 with the threshold. The controller 18 may estimate the temperature based on a current value that flows through the first temperature sensor 62.

When the controller 18 makes a negative determination at S35 (S35: NO), the controller 18 determines whether the FAN flag indicates the half speed (S49). When the controller 18 makes an affirmative determination at S49 (S49: YES), the controller 18 obtains the voltage value of the first temperature sensor 62 (S51) and subsequently determines whether the first detection temperature T1 is not less than the first temperature threshold TH2A (S53). When the first detection temperature T1 is not less than the first temperature threshold TH2A (S53: YES), the controller 18 switches the FAN flag from the half speed to the full speed (S55). When the first detection temperature T1 is less than the first temperature threshold TH2A (S53: NO), on the other hand, the controller executes S57.

At S57, the controller 18 obtains the voltage value of the second temperature sensor 67 and subsequently determines whether the second detection temperature T2 is not less than the second temperature threshold TH2B (S59). When the controller 18 makes an affirmative determination at S59 (S59: YES), the controller 18 executes S55. As well as in changing the rotation speed from the OFF to the half speed, in changing the rotation speed from the half speed to the full speed, the controller 18 causes the fan 61 to rotate at the full speed when one of the two conditions as to the first and second temperature thresholds TH2A, TH2B is satisfied. After executing S55, the controller 18 executes S47 in FIG. 9.

On the other hand, when the controller 18 makes a negative determination at S59 (S59: NO), the controller determines whether the first detection temperature T1 is not greater than the first temperature threshold TH4A (S61). When the controller 18 makes an affirmative determination at S61 (S61: YES), the controller 18 determines whether the second detection temperature T2 is not greater than the second temperature threshold TH4B (S63). When the controller 18 makes an affirmative determination at S63 (S63: YES), the controller 18 switches the FAN flag from the half speed to the OFF (S65). When the first detection temperature T1 is greater than the first temperature threshold TH4A, the controller 18 makes a negative determination at S61 (S61: NO) and then executes S47 in FIG. 9 without changing the FAN flag. Also when the second detection temperature T2 is greater than the second temperature threshold TH4B (S63: NO), the controller 18 executes S47 in FIG. 9 without changing the FAN flag.

In the determination as to shifting from the half speed to the OFF, the controller 18 changes the rotation speed of the fan 61 from the half speed to the OFF when both the conditions as to the first and second temperature thresholds TH4A, TH4B are satisfied. In other words, if any one of the conditions relating to the first and second temperature thresholds TH4A, TH4B indicates that the half speed is to be maintained, the fan 61 is kept rotated at the half speed. The controller 18 may turn off the fan 61 when one of the conditions relating to the first and second temperature thresholds TH4A, TH4B is satisfied.

When the controller 18 makes a negative determination at S49 (S49: NO), namely, when the FAN flag indicates the full speed, the controller executes S67 in FIG. 8. The controller 18 obtains the voltage value of the first temperature sensor 62 (S67) and subsequently determines whether the first detection temperature T1 is not greater than the first temperature threshold TH3A (S69). When the controller 18 makes an affirmative determination at S69 (S69: YES), the controller 18 obtains the voltage value of the second temperature sensor 67 (S71) and subsequently determines whether the second detection temperature T2 is not greater than the second temperature threshold TH3B (S73). When the controller 18 makes an affirmative determination at S73 (S73: YES), the controller 18 switches the FAN flag from the full speed to the half speed (S75). As well as in changing the rotation speed from the half speed to the OFF, the controller 18 changes the rotation speed of the fan 61 from the full speed to the half speed when both the conditions relating to the first and second temperature thresholds TH3A, TH3B are satisfied.

Figure 9:
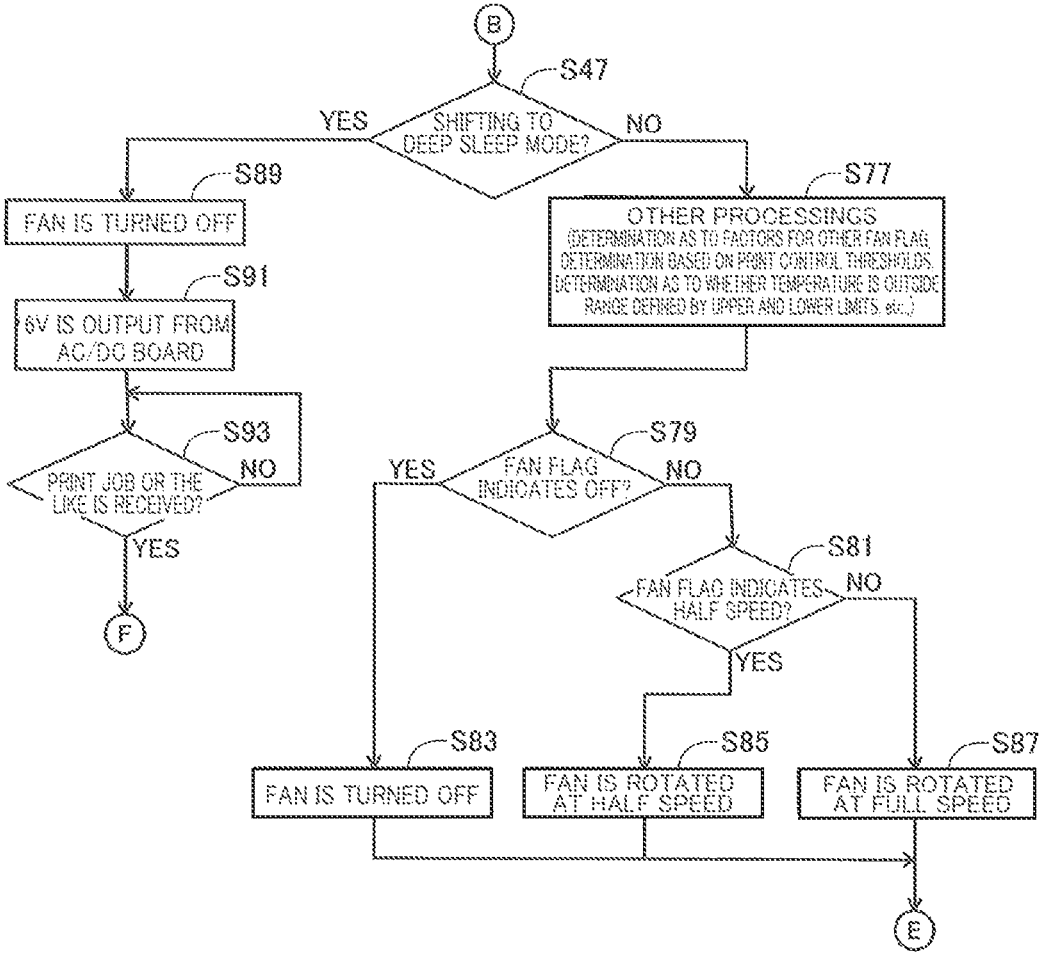
FIG. 9 is a part of the flowchart representing the fan control processing.

After executing S75, the controller 18 executes S47 in FIG. 9. When the controller 18 makes a negative determination at S69 (S69: NO) or when the controller 18 makes a negative determination at S73 (S73: NO), the controller executes S47 in FIG. 9 with the FAN flag set at the full speed.

At S47, the controller 18 determines whether the condition for shifting to the deep sleep mode is satisfied. For instance, the printing is executed in the print mode. When the printing is completed and there is no longer left any print job to be executed, the controller 18 causes the printer 1 to shift to the ready mode. In a case where no request or the like for executing the print job is made for a predetermined length of time in the ready mode, the controller 18 causes the printer 1 to shift to the deep sleep mode.

The controller 18 makes a negative determination at S47 (S47: NO) when the print job is being executed, when there is left any print job to be executed, or when the print job is newly received in the ready mode. The controller 18 subsequently executes S77 at which the controller 18 executes other processings such as a processing of obtaining information on factors, other than the first and second detection temperatures T1, T2, that cause the control of the fan 61 to be changed.

At S77, the controller 18 may make a determination as to the speed of the fan 61 based on the temperature of the heater 51A detected by the third temperature sensor 53. The controller 18 may switch the FAN flag from the OFF to the half speed or the full speed when the detection temperature of the third temperature sensor 53 reaches a predetermined threshold even though the first and second detection temperatures T1, T2 do not reach the thresholds indicated above. In a case where the second temperature sensor 67A is provided on the primary side of the AC/DC circuit 71 (FIG. 3) in addition to the second temperature sensor 67 provided on the secondary side of the AC/DC circuit 71, the FAN flag may be changed based on the detection temperature by the second temperature sensor 67A on the primary side.

At S77, the controller 18 may determine a factor that causes the fan 61 to rotate, other than the temperature. The charging device 41 (FIG. 2) of the printing device 12 generates a corona discharge to positively charge the photoconductive drum 31. When the corona discharge is generated, ozone may sometimes be generated. If ozone is accumulated in the housing 2, the components of the printer 1 may be deteriorated. To prevent the deterioration of the components, the fan 61 needs to be rotated to discharge ozone outside the housing 2. In view of this, the controller 18 may switch the FAN flag to the half speed or the full speed (S77) when the discharge voltage of the charging device 41 becomes equal to or higher than a predetermined voltage, when a continuous discharging time or a cumulative discharging time of the charging device 41 becomes equal to or greater than a predetermined length of time, or when a cumulative time during which the discharge by the charging device 41 is executed without rotating the fan 61 becomes equal to or greater than a predetermined length of time, for instance.

The controller 18 gives a higher priority to one of the determination results for the FAN flag respectively set at S41, S55, S65, S75 and the determination result for the FAN flag obtained at S77, which one of those determination results indicates the highest speed. In a case where the controller 18 determines at S77 to set the FAN flag to the half speed for discharging ozone outside the housing 2 even though the FAN flag before executing S77 indicates the OFF, the controller 18 sets the FAN flag to the half speed. The controller 18 does not necessarily give a higher priority to the fastest speed. For instance, the controller 18 may give a higher priority to the determination result that indicates the lowest speed. The controller 18 may assign weight to a plurality of determination results and may finally determine the speed based on a sum of products obtained by multiplying the determination results with respective weighting coefficients.

After executing S77, the controller 18 executes S79, S81 so as to control the fan 61 in consideration of the determination result at S77. When the FAN flag indicates the OFF (S79: YES), the controller 18 turns off the fan 61 to stop rotating the fan 61 (S83). When the FAN flag indicates the half speed (S79: NO, S81: YES), the controller 18 causes the fan 61 to rotate at the half speed (S85). When the FAN flag indicates the full speed (S79: NO, S81: NO), the controller 18 causes the fan 61 to rotate at the full speed (S87). After executing any one of S83, S85, S87, the controller 18 again executes S35 and subsequent steps in FIG. 7. This configuration allows detailed analysis of the temperature change in the housing 2 by the first and second temperature sensors 62, 67 in the print mode and the ready mode, thus allowing fine switching of the rotation speed of the fan 61.

The processing details of S77 are described only by way of example. The controller 18 may make the above determination utilizing the print control thresholds TP1, TP2 illustrated in FIG. 4, for instance. The controller 18 may suspend the printing process while rotating the fan 61 at the full speed when the first detection temperature T1 becomes not less than the print control threshold TP1. In a case where the toner cartridges 33 continue to perform printing in a state in which the first detection temperature T1 is greater than the print control threshold TP1, the toner cartridges 33 may be partially molten. In view of this, at S77, when the first detection temperature T1 becomes not less than the print control threshold TP1, the controller 18 may stop the toner cartridges 33 and the fixing device 50 from operating and may rotate the fan 61 at the full speed to cool the interior of the housing 2 until the first detection temperature T1 becomes not greater than the print control threshold TP2.

The controller 18 may forcibly rotate the fan 61 when the first and second detection temperatures T1, T2 become not less than respective predetermined upper limit values or become not greater than respective predetermined lower limit values. In a case where the first and second detection temperatures T1, T2 are not less than the respective upper limit values or not greater than the respective lower limit values, there is a possibility that the first and second temperature sensors 62, 67 suffer from a malfunction and accordingly fail to properly detect the temperatures. Thus, at S77, when the first and second detection temperatures T1, T2 are not less than the respective upper limit values, for instance, the controller 18 may rotate the fan 61 at the full speed during execution of the printing process. According to this configuration, in a case where the temperature state in the housing 2 is unclear due to the malfunction or the like, the printing can be completed while the fan 61 is forcibly rotated.

When the controller 18 determines at S47 that the condition for shifting to the deep sleep mode is satisfied (S47: YES), the controller 18 turns off the fan 61 (S89) and lowers the output voltage of the AC/DC board 65 from 24 V to 6 V (S91), whereby the printer 1 shifts to the deep sleep mode. The controller 18 then makes a determination as to the condition for shifting from the deep sleep mode to the ready mode or the print mode (S93).

When the print job is newly received in the deep sleep mode, the controller 18 makes an affirmative determination at S93 (S93: YES). The controller 18 then executes processing at and after S27 in FIG. 6. The controller 18 causes the printer 1 to shift to the print mode and controls the fan 61 while executing the printing process. The condition for shifting from the deep sleep mode to the ready mode or the print mode is not limited to the condition that the print job is newly received. For instance, the controller 18 may cause the printer 1 to shift to the ready mode when the operational input to the user interface 17 is received (S93: YES). The controller 18 maintains the deep sleep mode for power saving until the factor that causes the printer 1 to shift to the ready mode or the print mode occurs (S93: NO).

Figure 10:
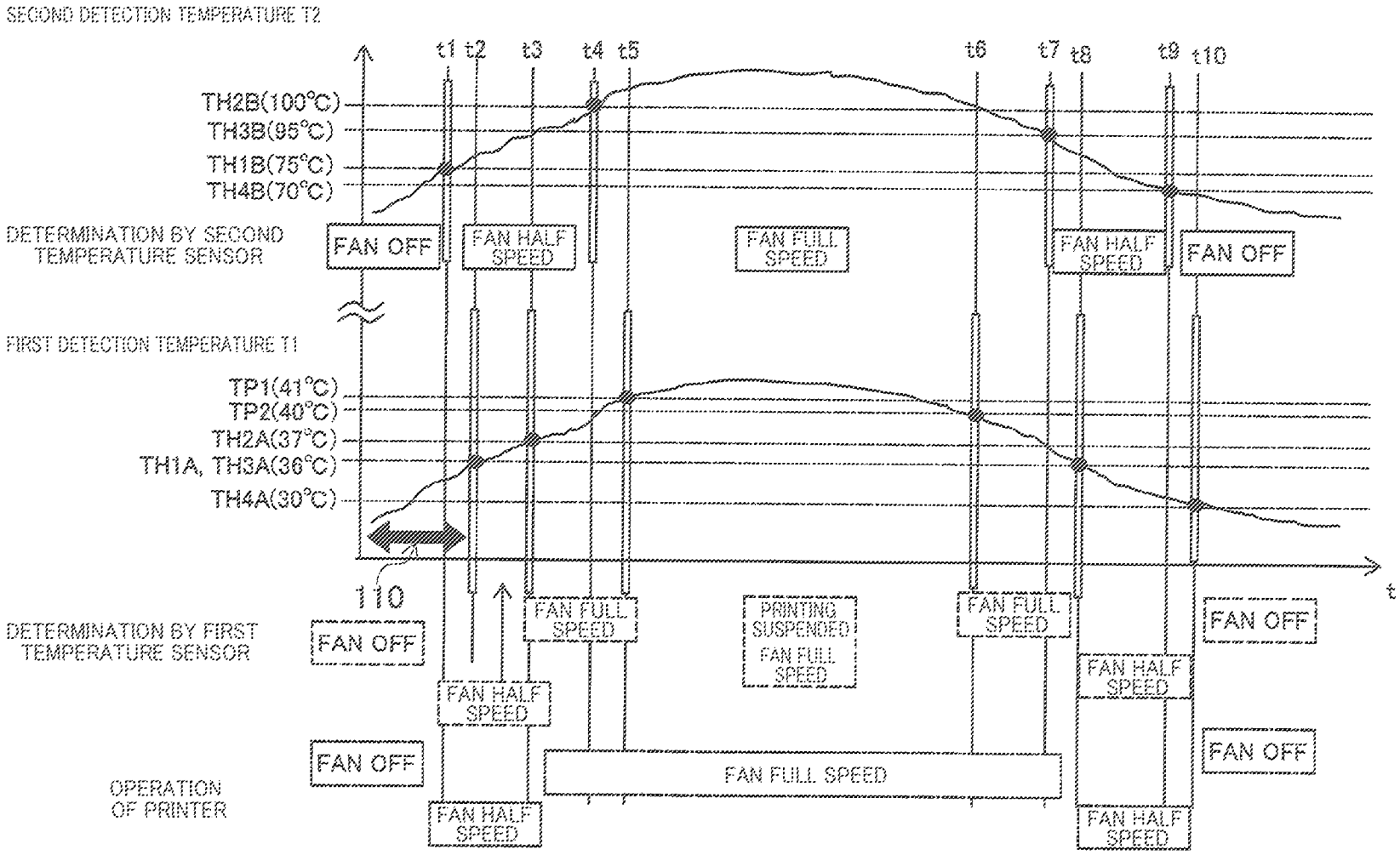
FIG. 10 is a graph illustrating a relationship between changes in first and second detection temperatures and control details of the fan.

FIG. 10 illustrates a relationship between changes in the first and second detection temperatures T1, T2 and the control details of the fan 61. The horizontal axis in FIG. 10 indicates time t. The vertical axis in the upper graph in FIG. 10 indicates the second detection temperature T2. The vertical axis in the lower graph in FIG. 10 indicates the first detection temperature T1. The thresholds in FIG. 10 are those of the manufacturer 1 as one example. Between the upper graph and the lower graph, the determination results by the second temperature sensor 67 are illustrated. (Each determination result is enclosed in the solid-line rectangle.) Below the lower graph, the determination results by the first temperature sensor 62 are illustrated. (Each determination result is enclosed in the broken-line rectangle.) Below the determination results by the first temperature sensor 62, there are illustrated final operational contents of the printer 1 based on the determination results in the fan control processing. (Each operational contents is enclosed in the dash-dotted-line rectangle.) In the explanation below, the condition that the first detection temperature T1 satisfies any of the first temperature thresholds TH1A-TH4A is referred to as a first condition, and the condition that the second detection temperature T2 satisfies any of the second temperature thresholds TH1B-TH4B is referred to as a second condition.

After causing the printer 1 to shift to the print mode and starting to execute the received print job at S27 in FIG. 6, the controller 18 causes the heater 51A and the printing device 12 to operate so as to start the printing process. Accordingly, the first detection temperature T1 and the second detection temperature T2 increase. As described above, the FAN flag is set to "OFF" as the initial value. Thus, the controller 18 does not rotate the fan 61 but keeps the fan 61 stopped at an initial stage of the printing process.

At a time t1, the second detection temperature T2 reaches the second temperature threshold TH1B. Subsequently, at a time t2, the first detection temperature T1 reaches the first temperature threshold TH1A. Of the first and second conditions each for changing the rotation speed of the fan 61 from the OFF to the half speed, the second condition (T2≥TH1B) is satisfied earlier than the first condition. Accordingly, the fan 61 is kept OFF till the time t1 and is then rotated at the half speed at the time t1.

As illustrated by the processing of FIGS. 6-9, even if the first condition is satisfied earlier than the second condition (each of the first and second conditions being for changing the rotation speed to the half speed), the controller 18 causes the fan 61 to rotate at the half speed. Accordingly, the controller 18 causes the fan 61 to rotate at the same target rotation speed irrespective of which one of the first and second conditions is satisfied. Further, the controller 18 causes the fan 61 to rotate at the half speed also when both the first and second conditions are satisfied. The controller 18 may change the rotation speed of the fan 61 based on the satisfaction of the first condition and/or the second condition. For instance, the controller 18 may execute a stepwise control as follows. The rotation speed of the fan 61 is set to a low speed when the first detection temperature T1 in the first condition is not less than the first temperature threshold TH1A, a middle speed when the second detection temperature T2 in the second condition is not less than the second temperature threshold TH1B, and a high speed when both the first and second conditions are satisfied. Alternatively, the controller 18 may execute a control in which the rotation speed of the fan 61 is set to a low speed when only one of the first and second conditions is satisfied and a middle speed when both the first and second conditions are satisfied.

As illustrated in FIG. 10, the controller 18 executes a control in which the fan 61 is kept OFF for a predetermined length of time 110 after starting the print job. Specifically, the controller 18 keeps the fan 61 stopped when both the first and second conditions are not satisfied for the predetermined length of time 110 after starting to execute the print job. Accordingly, the fan 61 is kept stopped in a case in which the first detection temperature T1 does not become not less than the first temperature threshold TH1A and the second detection temperature T2 does not become not less than the second temperature threshold TH1B for the predetermined length of time 110. In this configuration, the fan 61 is not rotated as much as possible even if the printing is started, thus allowing a reduced operating noise of the printer 1 as compared with a conventional fan control in which the fan 61 is rotated in conjunction with starting the print job.

Here, the predetermined length of time 110 is a length of time determined based on the number of sheets to be printed by the user. For instance, the predetermined length of time 110 is determined based on the number of sheets that can be printed continuously. Specifically, the predetermined length of time 110 is a length of time necessary for performing printing on all the sheets P stored in the sheet-supply tray 11 in one printing operation in a case where the maximum number of the sheets P storable in one sheet-supply tray 11 are stored in the same 11. The predetermined length of time 110 is not limited to the printing time of the maximum number of sheets but may be a printing time of the average number of sheets on which the printing is performed by one print instruction in usage by the user. The controller 18 may set the predetermined length of time 110 not only for the print job but also for the scan job and the FAX job, to attain a reduced operating noise of the printer 1. In a case where a plurality of the print jobs are executed, the controller 18 may set the predetermined length of time 110 at the time of executing a first one of the plurality of the print jobs and may reset the predetermined length of time 110 every time when the print job starts to be executed. The controller 18 need not set the predetermined length of time 110 necessarily at the time of starting the print job. The controller 18 may set the predetermined length of time 110 from a time point when other condition is satisfied such as when the first detection temperature T1 becomes not greater than the first temperature threshold TH4A.

The controller 18 causes the fan 61 to rotate when the predetermined length of time 110 elapses after starting to execute the print job even if both the first and second conditions for changing the rotation speed of the fan 61 from the OFF to the half speed are not satisfied (T1≥TH1A, T2≥TH1B). For instance, the controller 18 causes the fan 61 that is in the stop state to rotate at the half speed when the predetermined length of time 110 elapses even if the first detection temperature T1 is less than the first temperature threshold TH1A and the second detection temperature T2 is less than the second temperature threshold TH1B. The controller 18 makes this determination as to the predetermined length of time 110 at S77 in FIG. 9, for instance. With this configuration, the fan 61 is rotated for performing cooling in a case where the printing is performed for a long time beyond the predetermined length of time 110. Even after the predetermined length of time 110 has elapsed, the controller 18 may keep the fan 61 off until at least one of the first and second conditions is satisfied. The controller 18 may cause the fan 61 to rotate at a low speed when the predetermined length of time 110 elapses and may cause the fan 61 to rotate at a middle speed when the first detection temperature T1 becomes not less than the first temperature threshold TH1A or when the second detection temperature T2 becomes not less than the second temperature threshold TH1B.

The controller 18 sets the target rotation speed of the fan 61 (low speed) when the predetermined length of time 110 elapses so as to be equal to the target rotation speed (half speed) when at least one of the first and second conditions (T1≥TH1A, T2≥TH1B) is satisfied. This configuration simplifies control details for controlling the fan 61. The speed of the fan 61 may differ between when the predetermined length of time 110 elapses and when the first and second conditions are satisfied.

At a time t3, the first detection temperature T1 reaches the first temperature threshold TH2A. Subsequently, at a time t4, the second detection temperature T2 reaches the second temperature threshold TH2B. Of the first and second conditions each for changing the speed of the fan 61 from the half speed to the full speed, the first condition is satisfied earlier than the second condition, as in changing the speed of the fan 61 to the half speed. Thus, the fan 61 is rotated at the half speed from the time t1 to the time t3 and is then rotated at the full speed at the time t3.

At a time t5, the first detection temperature T1 reaches the print control threshold TP1. The controller 18 suspends the printing at S77 in FIG. 9. The devices involved in the printing come to stop, so that the temperature in the housing 2 is lowered and the first detection temperature T1 is accordingly lowered to the print control threshold TP2 at a time t6. Irrespective of the first and second detection temperatures, the fan 61 is rotated at the full speed and the printing is suspended for a time period from the time t5 to the time t6. At the time t6, the controller 18 resumes the printing in a state in which the fan is rotated at the full speed.

At a time t7, the second detection temperature T2 is lowered to the second temperature threshold TH3B. Subsequently, at a time t8, the first detection temperature T1 is lowered to the first temperature threshold TH3A. Because the condition for changing the speed of the fan 61 to the full speed is satisfied for the first condition although the condition for changing the speed of the fan 61 to the half speed is satisfied for the second condition at the time t7, the controller 18 gives a higher priority to a higher speed, i.e., the full speed. At the time t8 at which the condition for changing the speed of the fan 61 to the half speed is satisfied for both the first and second conditions, the controller 18 changes the speed of the fan 61 from the full speed to the half speed. Accordingly, the controller 18 rotates the fan 61 at the full speed for a time period from the time t3 to the time t8.

At a time t9, the second detection temperature T2 is lowered to the second temperature threshold TH4B. Thereafter, at a time t10, the first detection temperature T1 is lowered to the first temperature threshold TH4A. As well as in changing the speed of the fan 61 from the full speed to the half speed, the controller 18 turns off the fan 61 at the time t10 at which the condition for changing the sped of the fan 61 to the OFF is satisfied for both the first and second conditions. Accordingly, the controller 18 rotates the fan 61 at the half speed for a time period from the time t8 to the time t10.

The changes of first and second detection temperatures T1, T2 and the control details are described only by way of example. In a case where the print job starts to be executed and the fan 61 is rotated, the controller 18 may rotate the fan 61 at the half speed or higher until shifting to the ready mode even if the first detection temperature T1 and the second detection temperature T2 are lowered. In this instance, the controller 18 may not execute the above determinations utilizing the first temperature threshold TH4A and the second temperature threshold TH4B. The controller 18 makes the determination as to changing the speed of the fan 61 from the half speed to the OFF based on only the second detection temperature T2.

6. Location of Second Temperature Sensor 67 and Temperature Estimation

The locations of the first and second temperature sensors 62, 67 and the control details of the fan 61 based on the first and second temperature sensors 62, 67 are described only by way of example. In the illustrated embodiment, the second temperature sensor 67 is disposed on the secondary side of the transformer 78 of the AC/DC circuit 71. The location of the second temperature sensor 67 is not so limited. The location of the second temperature sensor 67 may be changed depending on the voltage value of the alternating current power source AC, for instance. Specifically, the current amount that flows through the element on the primary side is larger when the AC/DC board 65 is connected to the alternating current power source AC whose AC voltage Vac is 100 V than when connected to the alternating current power source AC whose AC voltage Vac is 200 V if the output current or the load on the output side of the AC/DC board 65 is the same. Thus, the heat generation amount of the element on the primary side may be large in countries, such as Japan, where the commercial power source of 100 V is used. Thus, the second temperature sensor 67 is desirably disposed on the primary side to detect the temperature of the element on the primary side and to compare the detected temperature with the thresholds.

Figure 11:
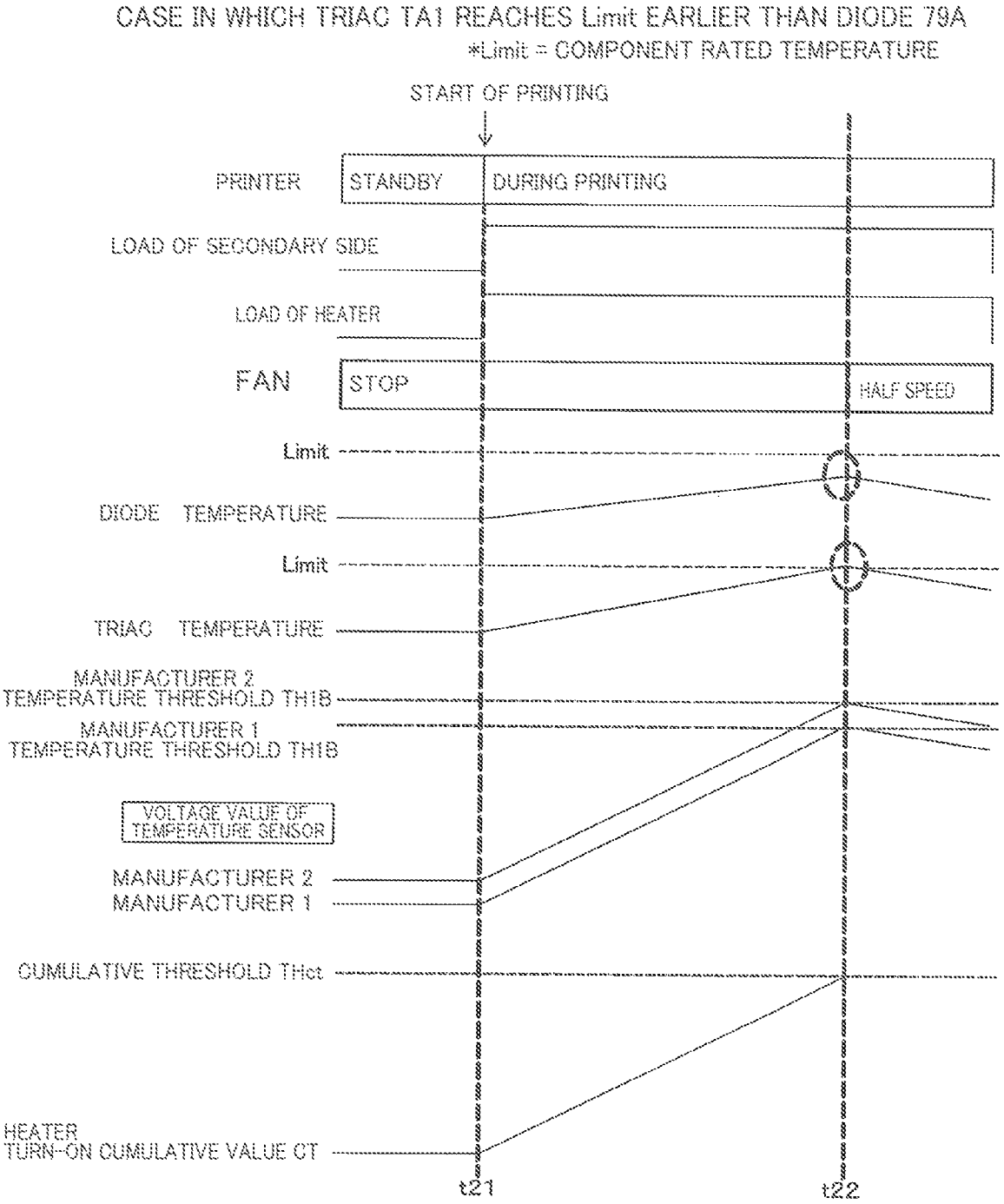
FIG. 11 is a timing chart relating to a temperature rise state of a secondary-side diode and a primary-side triac and rotation of the fan obtained when the fan is rotated in accordance with the temperature rise.

FIG. 11 is a timing chart indicating the temperature rise state of the diode 79A on the secondary side and the triac TA1 on the primary side obtained when the fan 61 is rotated in accordance with the temperature rise. In the example of FIG. 11, the controller 18 starts printing at a time t21 from the standby state such as the deep sleep mode or the ready mode. After the printing has started, the temperatures of the diode 79A and the triac TA1 increase. In FIG. 11, "Limit" indicates a rated temperature of the diode 79A and a rated temperature of the triac TA1. In the example of FIG. 11, after the printing process has started, the temperature of the triac TA1 on the primary side reaches the rated temperature at a time t22 (as illustrated in the dashed-line circle in FIG. 11) earlier than the temperature of the diode 79A on the secondary side. In such an instance in which the temperature of the element on the primary side rises earlier than that of the element on the secondary side, it is desirable to monitor the temperature of the primary-side element.

In countries that use the commercial power source of a relatively high voltage such as 200 V, as compared with the countries like Japan, the heat generation amount of the element on the primary side is relatively small as compared with that in the countries that use the commercial power source of 100 V. In the countries that use the alternating current power source AC of such a high voltage, the temperature rise on the secondary-side element is great as compared with the countries that use the commercial power source of 100 V. It is thus desirable to dispose the second temperature sensor 67 on the secondary side and to monitor the temperature on the secondary side. In a case where the temperature of the diode 79A on the secondary side reaches the rated temperature earlier than the temperature of the triac TA1 on the primary side after the printing process has been started, it is desirable to monitor the temperature of the diode 79A. Thus, the location of the second temperature sensor 67 may be changed depending on the level of the voltage value of the AC voltage Vac of the alternating current power source AC.

In the present embodiment, the followability of the manufacturer 1 is lower than that of the manufacturer 2. In this instance, the voltage value of the second temperature sensor 67 provided on the AC/DC board 65 manufactured by the manufacturer 1 increases with some delay relative to the voltage value of the second temperature sensor 67 provided on the AC/DC board 65 manufactured by the manufacturer 2. In view of this, the second temperature threshold TH1B for the manufacturer 1 is made lower than that for the manufacturer 2 in consideration of the followability, as illustrated in FIG. 11. This configuration enables the fan 61 to rotate at the half speed before the diode 79A and the triac TA1 reach the respective rated temperatures, thus obviating an occurrence of a failure of the elements.

In a case where the second temperature sensor 67 is disposed on the high-voltage side that is the primary side of the AC/DC circuit 71, it is needed to increase insulation in the transmission path of the detection signals for outputting the detection signals of the second temperature sensor 67 on the high-voltage side to the controller 18 on the low-voltage side. For increasing insulation with respect to the alternating current power source AC, it is needed to convert the detection signals of the second temperature sensor 67 into photo signals by a photocoupler or the like so as to transmit the converted signals to the controller 18, for instance. This, however, leads to an increased production cost of the circuit for temperature detection.

In such a case where the second temperature sensor 67 is disposed on the secondary side in view of insulation but, nevertheless, the temperature of the element on the primary side is desired to be monitored because of a concern about the temperature rise, the temperature of the primary-side element may be estimated based on the detection result by the second temperature sensor 67 on the secondary side. In a case where the temperature of the triac TA1 on the primary side reaches the rated temperature earlier than the temperature of the diode 79A on the secondary side as illustrated in FIG. 11, the temperature of the triac TA1 may be estimated based on the detection result by the second temperature sensor 67.

The temperature may be estimated according to any suitable technique. The heat generation amount of the triac TA1 or the transistor Q1 for driving the transformer 78, both of which are on the primary side, is proportional to the heat generation amount of the diode 79A or the sensing resistor 85 both of which are on the secondary side. Accordingly, the temperature of the primary-side element (such as the triac TA1 or the transistor Q1) may be estimated based on the detection temperature or the detection voltage detected by the secondary-side second temperature sensor 67. On the contrary, the temperature of the secondary-side element may be estimated based on the detection temperature or the like detected by the second temperature sensor 67 disposed on the primary side.

The temperature of the element may be estimated without using any temperature detecting sensor such as the second temperature sensor 67. The heat generation amount of the secondary-side element is proportional to the square of the output current of the AC/DC circuit 71. Thus, the temperature of the secondary-side element may be estimated based on the amount of the output current of the AC/DC circuit 71. For instance, a current sensor may be connected to an output portion of the voltage detecting circuit 81, and the temperature of the diode 79A may be estimated based on the current value detected by the current sensor. Further, the temperature of the primary-side element may be estimated based on the estimated temperature of the secondary-side element.

The heat generation amount of the triac TA1 on the primary side is proportional to the number of turn-ons of the heater 51A, namely the number of times by which the heater 51A is energized. Accordingly, the temperature of the triac TA1 may be estimated based on the number of turn-ons of the triac TA1. As illustrated in FIG. 2, the controller 18 controls the number of turn-ons of the heater 51A based on the heater control signal CI2 output to the phototriac coupler PC4. Accordingly, the controller 18 is capable of obtaining the number of turn-ons of the heater 51A. As illustrated in FIG. 11, the temperature of the triac TA1 is proportional to the turn-on cumulative value CT that is a sum of the number of turns-on by which the heater 51A is turned on. In view of this, the controller 18 may cause the fan 61 to rotate at the half speed when the turn-on cumulative value CT becomes equal to a predetermined cumulative threshold THct. Specifically, the controller 18 may determine whether the turn-on cumulative value CT per unit time or the temperature estimated based on the turn-on cumulative value CT becomes equal to the cumulative threshold THct or the temperature threshold. With this configuration, the temperature of the triac TA1 can be determined based on the turn-on cumulative value CT.

Figure 7:
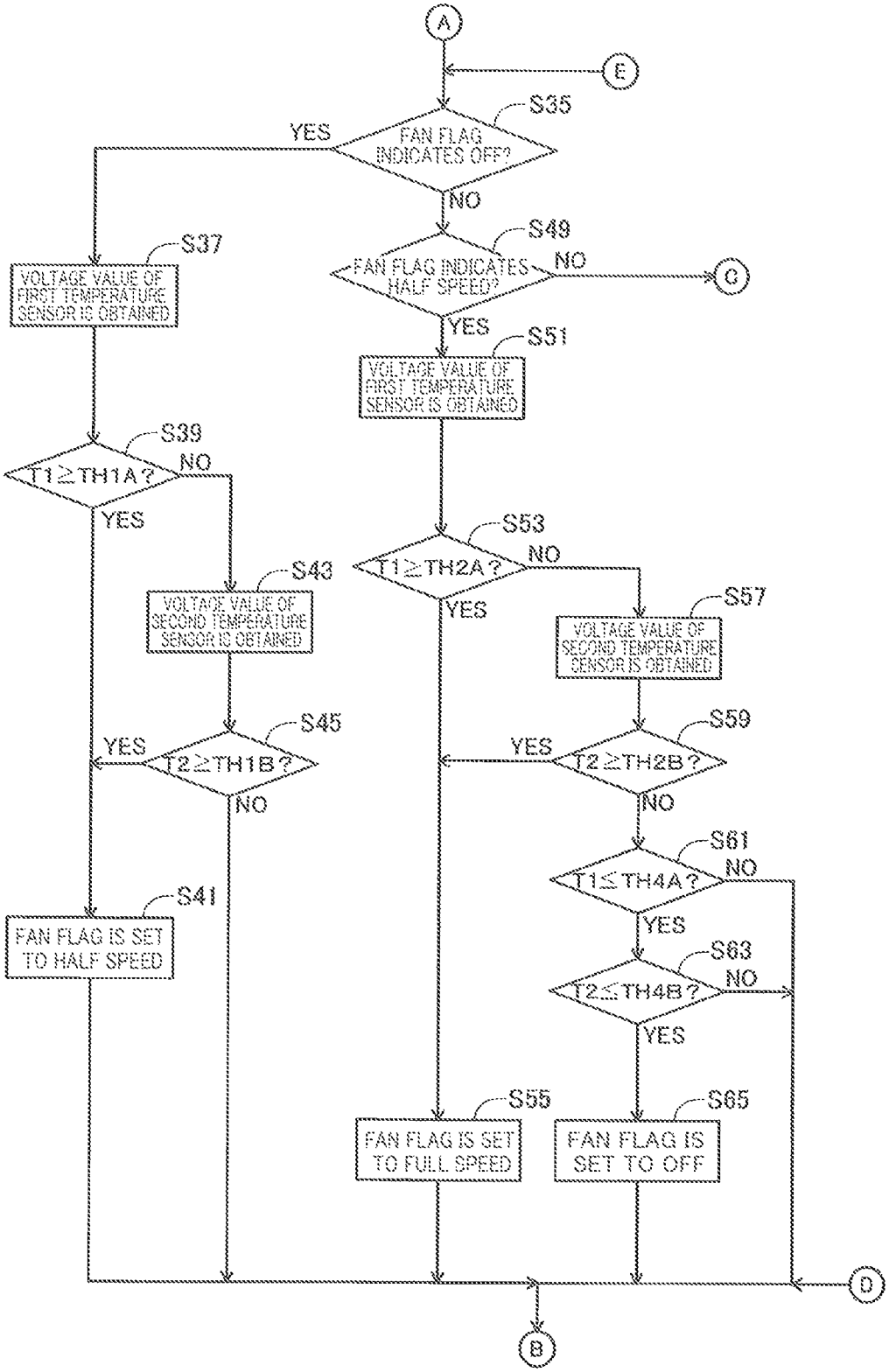
FIG. 7 is a part of the flowchart representing the fan control processing.
Figure 8:
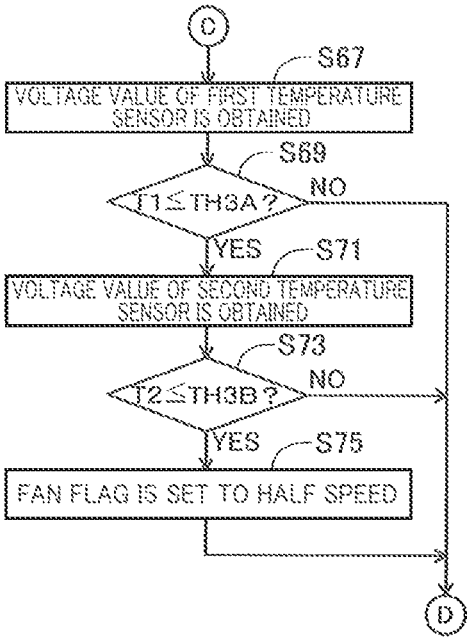
FIG. 8 is a part of the flowchart representing the fan control processing.
Figure 12:
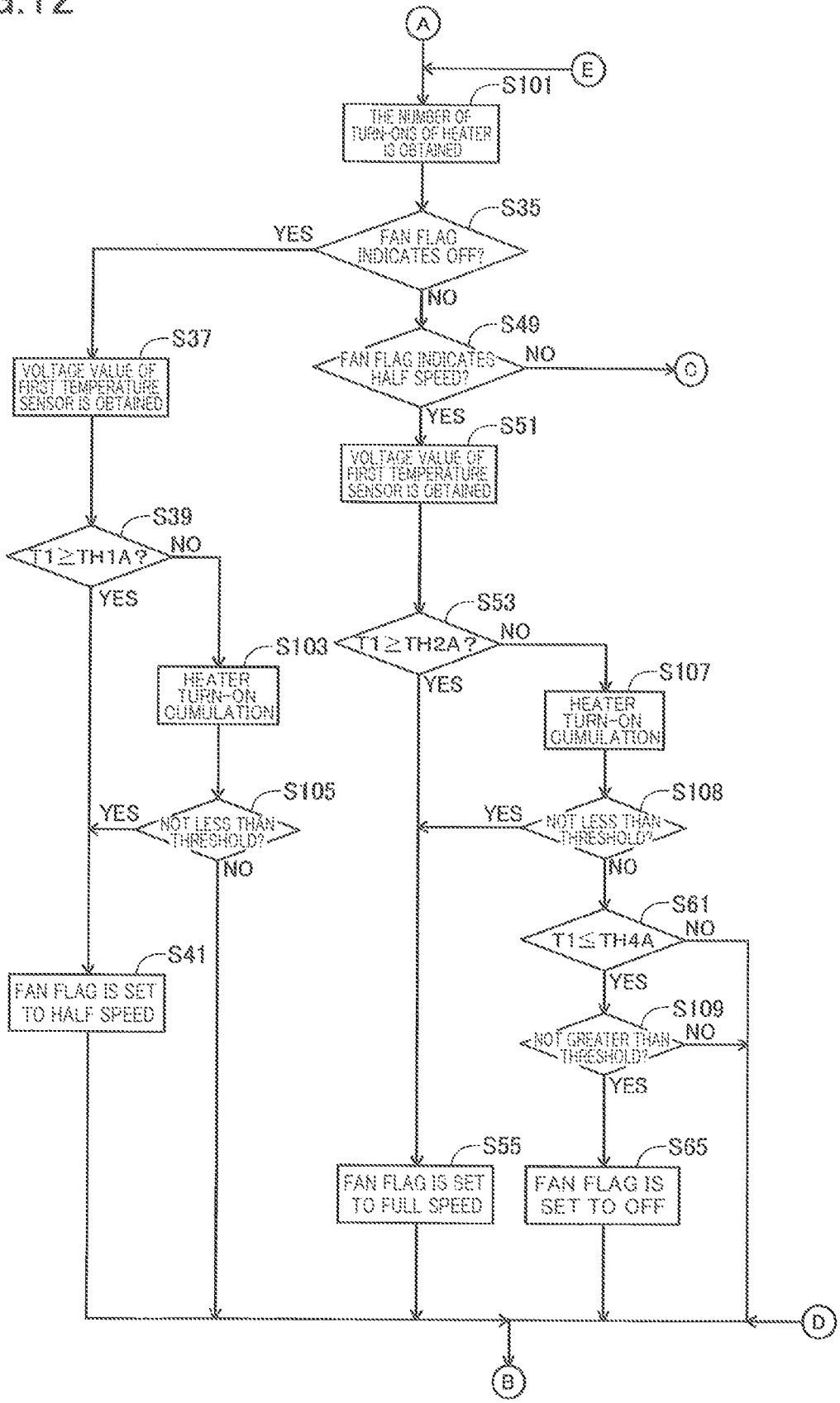
FIG. 12 is a part of a flowchart representing a fan control processing according to another embodiment.

FIG. 12 illustrates contents of a fan control processing according to another example. The same reference signs as used in the processing in FIG. 7 are used in the processing in FIG. 12 to identify similar processings. In the fan control processing illustrated in FIG. 12, the controller 18 makes a determination based on the turn-on cumulative value CT of the heater 51A in place of the determination based on the second detection temperature T2 by the second temperature sensor 67. For instance, the controller 18 sets thresholds for each of the manufacturers 1, 2 at S32 or S34 in FIG. 6. The thresholds may be the cumulative threshold THct that is compared with the turn-on cumulative value CT per unit time or the temperature threshold for determining the estimated temperature of the triac TA1 estimated based on the turn-on cumulative value CT.

At S101 in FIG. 12, the controller 18 obtains the number of turn-ons of the heater 51A. At S103, the controller 18 recognizes the turn-on cumulative value CT based on the number of turn-ons obtained at S101. For instance, the controller 18 calculates, as the turn-on cumulative value CT, the number of half waves of the AC voltage that flows through the heater 51A by turning on the heater 51A per unit time. Alternatively, the controller 18 calculates, as the turn-on cumulative value CT, the number of half waves of the AC voltage that flows through the heater 51A before S101 is currently executed after previous execution of S101. The controller 18 may estimate at S103 the temperature of the triac TA1 based on the turn-on cumulative value CT. At S105, the controller 18 compares the turn-on cumulative value CT calculated at S103 or the estimated temperature with the threshold. This threshold is the cumulative threshold THct for changing the FAN flag from the OFF to the half speed. When the turn-on cumulative value CT is not less than the cumulative threshold THct, the controller 18 sets the FAN flag to the half speed (S41). Similarly, in the determination (S107, S108, S109) when the rotation speed of the fan 61 is the half speed and determination (not shown) when the rotation speed of the fan 61 is full speed, the controller 18 changes the settings of the FAN flag by comparing the turn-on cumulative value CT or the estimated temperature with the cumulative threshold THct or the like. The thresholds used in S105, S108, S109 may be the thresholds set at S32 and S34 for every manufacturer. With this configuration, the controller 18 can execute the control of the fan 61 depending on the temperature state of the printer 1 based on the detection results by the first temperature sensor 62 and the turn-on cumulative value CT.

The thresholds (such as the cumulative threshold THct) used in S105, S108, S109 may be a constant value irrespective of the followability. The controller 18 may change the cumulative threshold THct in accordance with the degree of the followability. In a case where the voltage-current characteristics of the triac TA1 or the resistor value of the heater 51A differs between the manufacturer 1 and the manufacturer 2 and the followability of the turn-on cumulative value CT or the estimated temperature with respect to the actual temperature of the triac TA1 differ between the two manufacturers 1, 2, the controller 18 may change the cumulative threshold THct or the like for every manufacturer. The controller 18 may change a correction coefficient to be multiplied with one cumulative threshold THct, instead of changing the cumulative threshold THct or the temperature threshold depending on the degree of the followability.

The heat generation amount of the triac TA1 is proportional to the current amount that flows from the triac TA1 to the heater 51A. Accordingly, the controller 18 may estimate the temperature of the triac TA1 based on the current amount that flows through the triac TA1 or the heater 51A. The current amount that flows through the triac TA1 is proportional to the voltage value of the AC voltage Vac applied to the triac TA1. Accordingly, in a case where the heat generation amount of the triac TA1 is estimated based on the current amount that flows through the triac TA1, the controller 18 may correct the current amount in accordance with the voltage value of the input voltage of the triac TA1.

7. Processing Based on Job Type

In the illustrated embodiment, the print job for executing the printing is mainly explained among the jobs executed by the printer 1. The rotation of the fan 61 can be similarly controlled for other jobs, such as the scan job, based on the detection results by the first and second temperature sensors. In the AC/DC board 65, the temperature rise differs between the primary-side element and the secondary-side element depending on the type of the job. Specifically, when the print job is executed, heating by the heater 51A is necessary, so that the triac TA1 on the primary side is activated, resulting in an increase in the temperature of the triac TA1. In the jobs, such as the scan job and the FAX job, that do no cause the heater 51A to operate, on the other hand, the triac TA1 is not activated, and the temperature of the primary-side element is relatively low. In view of this, the controller 18 may change the first temperature threshold TH1A, etc., depending on whether the type of the received job is the print job or other jobs except for the print job. In changing the first temperature threshold TH1A, etc., the controller 18 may not use the manufacturer information of the sensing resistor Rdown or may use the manufacturer information in combination. The controller 18 may execute, for a copy job that causes the printing device 12 to operate, a processing similar to the processing for the print job.

Figure 13:
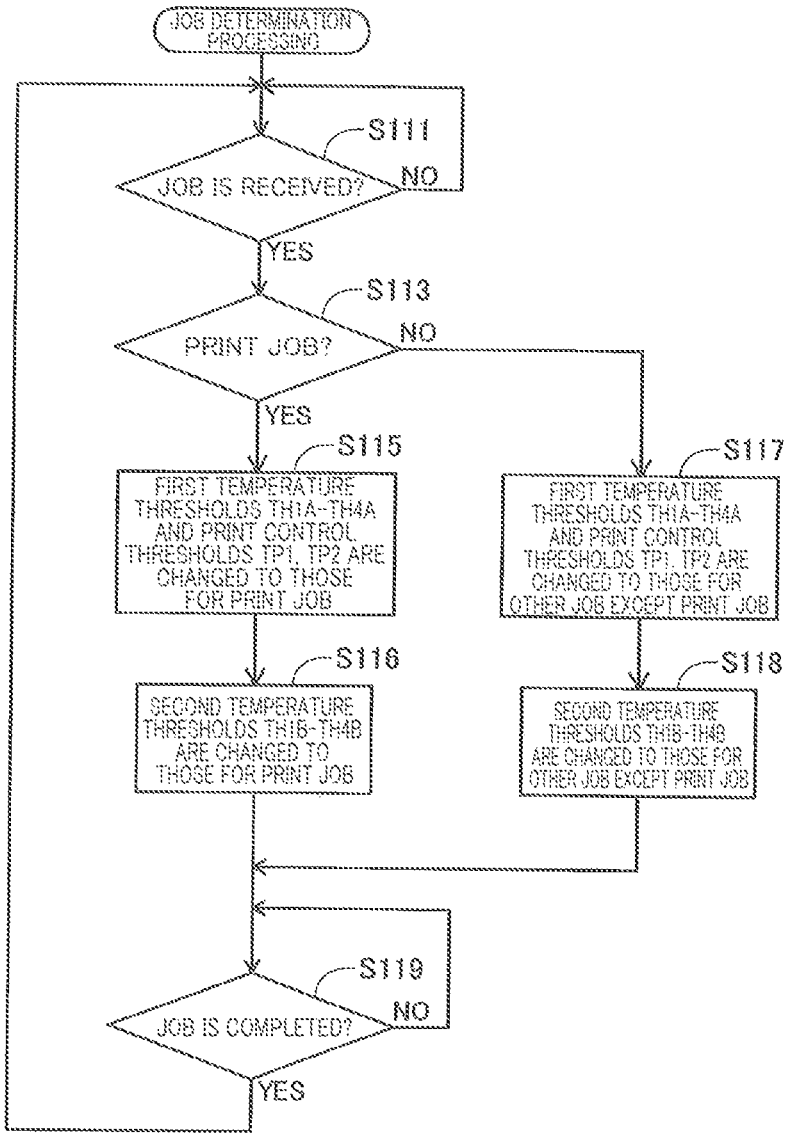
FIG. 13 is a flowchart representing a job determination processing for determining thresholds in accordance with a job type.

FIG. 13 illustrates contents of a job determination processing for changing the thresholds depending on the type of the job. The controller 18 executes the job determination processing in parallel with the fan control processing illustrated in FIGS. 6-9, for instance. The job determination processing of FIG. 13 may be inserted into a part of the fan control processing, so that the controller 18 may execute the two processings as one processing.

When the printer 1 is turned on, for instance, the controller 18 starts the processing of FIG. 13. When the processing of FIG. 13 starts, the controller 18 determines whether the job is received (S111). The controller 18 makes the determination of S111 until the job is received (S111: NO). When the job is received (S111: YES), the controller 18 determines whether the received job is the print job (S113).

When the received job is the print job (S113: YES), the controller 18 changes the first temperature thresholds TH1A-TH4A, the print control thresholds TP1, TP2, and the second temperature thresholds TH1B-TH4B to those for the print job (S115, S116). When the received job is the scan job or the FAX job (S113: NO), the controller 18 changes the first temperature thresholds TH1A, etc., to those for the received job other than the print job (S117, S118). After executing S116 or S118, the controller 18 determines whether the job received at S111 is completed (S119). When the job is completed, the controller 18 again executes the processing at and after S111 (S119: YES). Thus, every time a new job is received, the thresholds can be changed depending on whether the received job is the print job.

As described above, there is a possibility that the temperature of the primary-side element reaches the rated temperature earlier than the temperature of the secondary-side element in a case where the print job is executed. In this instance, if the second temperature sensor 67 is disposed for detecting the temperature of the secondary-side element, the temperature of the secondary-side element detected by the second temperature sensor 67 or the change in the temperature of the primary-side element estimated based on the detection temperature detected by the second temperature sensor 67 may have low followability with respect to the change in the actual temperature of the primary-side element (e.g., the triac TA1) that is desired to be monitored.

In view of the above, in a case where the second temperature sensor 67 is disposed on the secondary side, the controller 18 lowers the thresholds at S115, S116. This configuration enables satisfying conditions for the thresholds to be readily satisfied in executing the print job that causes the followability to be low, whereby the fan 61 can be readily rotated. Before the temperature of the triac TA1 on the primary side reaches the rated temperature, the fan 61 is rotated to cool the printer 1. Thus, the controller 18 may deal with the job type as the followability information and may change the thresholds based on the job type and the location of the second temperature sensor 67, for instance.

In the embodiment illustrated above, the printing device 12 is one example of an image forming device. The third temperature sensor 53 is one example of a third temperature detecting element. The first temperature sensor 62 is one example of a first temperature detecting element. The second temperature sensor 67 is one example of a second temperature detecting element. The transformer 78 is one example of a step-down transformer. Each of the diode 79A, the transistor Q1, and the triac TA1 is one example of an element mounted on the AC/DC board 65. The port 103 is one example of an input port. The second detection signal SI2 is one example of a first signal. The transistor Q4 is one example of a switch element. Each of the diode 79A and the sensing resistor 85 is one example of a secondary-side element. Each of the transistor Q1 and the triac TA1 is one example of a primary-side element.

8. Advantageous Effects

The present embodiment illustrated above offers the following advantageous effects.

(1) The controller 18 according to the present embodiment causes the fan 61 to rotate when at least one of the first condition and the second condition is satisfied (FIG. 10), the first condition being a condition in which the first detection temperature T1 detected based on the first detection signal SI1 of the first temperature sensor 62 is not less than the first temperature thresholds TH1A, TH2A, the second condition being a condition in which the second detection temperature T2 detected based on the second detection signal SI2 of the second temperature sensor 67 is not less than the second temperature thresholds TH1B, TH2B. With this configuration, the fan 61 can be rotated by evaluating, utilizing the two temperature sensors, a plurality of factors giving an influence on the temperature that causes to be driven.

(2) The controller 18 keeps the fan 61 stopped when both the first and second conditions, each of which is for changing the speed of the fan to the half speed, are not satisfied (S45: NO, S77) for the predetermined length of time 110 after starting to execute the print job. With this configuration, even when the printing device 12 starts printing based on the print job, the fan 61 is stopped for the predetermined length of time 110. Accordingly, the printing can be performed with a reduced operating noise.

(3) The controller 18 starts to control the fan 61 (S77) when the predetermined length of time 110 elapses after receiving the print job even if both the first and second conditions, each of which is for changing the speed of the fan 61 to the half speed, are not satisfied (S45: NO). With this configuration, in a case where the printing is performed for not less than the predetermined length of time, the fan 61 is operated to obviate a temperature rise in the apparatus.

(4) As the target rotation speed at which the fan 61 is rotated when the predetermined length of time 110 elapses, the controller 18 sets the half speed that is the target rotation speed at which the fan 61 is rotated when at least one of the first and second conditions is satisfied (S39: YES, S45: YES). This configuration simplifies the details of the processing executed by the controller 18 that controls the fan 61.

(5) The controller 18 sets the target rotation speed when the first condition is satisfied (S39: YES) so as to be equal to the target rotation speed when the second condition is satisfied (S45: YES) (S41). This configuration simplifies the details of the processing executed by the controller 18 that controls the fan 61.

(6) The controller sets the target rotation speed when only one of the first and second conditions is satisfied so as to be equal to the target rotation speed when both the first and second conditions are satisfied (S41). This configuration simplifies the details of the processing executed by the controller 18 that controls the fan 61.

(7) The controller 18 may obtain, as the turn-on cumulative value CT, a sum of the number of turn-ons by which the heater 51A is turned on and may start to control the fan 61 when the turn-on cumulative value CT becomes not less than the cumulative threshold THct (FIGS. 11, 12). With this configuration, the fan 61 is driven for cooling when the temperature rise occurs due to the turn-on of the heater 51A even though the temperature of the detecting target (such as the interior of the housing 2 or the diode 79A) of each of the first and second temperature sensors 62, 67 does not rise.

(8) The controller 18 may modify the second condition based on the followability information such as the manufacturer of the AC/DC board 65 or the job type. With this configuration, the second condition is readily satisfied even in a situation in which the change in the second detection temperature T2 is delayed with respect to the actual temperature of the diode 79A or the like and the followability is accordingly low, thus preventing the temperature of the diode 79A or the like from exceeding the rated temperature. Further, in a situation in which the followability is high, it is possible to prevent the fan 61 from unnecessarily rotating by making the second condition severe while preventing the temperature of the diode 79A or the like from exceeding the rated temperature.

(9) The controller 18 sets the thresholds for the manufacturer 1 with low followability so as to be lower than the thresholds for the manufacturer 2 with high followability (FIG. 4, S32, S34). According to this configuration, the second temperature thresholds TH1B, TH2B are lowered when the followability is low, thereby permitting the second condition to be readily satisfied. It is thus possible to prevent the temperature of the diode 79A or the like from exceeding the rated temperature.

(10) When the controller 18 executes the control of the fan 61 based on the turn-on cumulative value CT of the heater 51A, the controller 18 may control the fan 61 based on the followability information such as the manufacturers 1, 2, the job type, etc. The controller 18 may set the cumulative threshold THct when the followability information indicative of low followability is obtained so as to be lower than the cumulative threshold THct when the followability information indicative of high followability is obtained.

With this configuration, the fan 61 is driven for cooling when the temperature rise occurs due to the turn-on of the heater 51A even though the temperature of the detecting target of each of the first and second temperature sensors 62, 67 does not rise. Further, by correcting the cumulative threshold THct depending on the degree of the followability, it is possible to prevent the temperature of the diode 79A or the like from exceeding the rated temperature and to prevent the fan 61 from unnecessarily rotating.

(11) The port 103 is configured such that the second detection signal SI2 of the second temperature sensor 67 and the signal corresponding to the manufacturer 1, 2 of the AC/DC board 65 (as one example of a second signal of the present disclosure)(FIG. 6) are input. For instance, the sub CPU 102 of the controller 18 sets the signal output from the port 104 to the L level in the deep sleep mode and to the H level in the mode, such as the print mode or the ready mode, in which power saving is not intended. The transistor Q4 is configured to switch the signal input to the port 103 based on the output signal of the port 104.

With this configuration, the second detection signal SI2 and the signal for identifying the type of the manufacturer can be input through the common input port, thus reducing the number of the input ports necessary for the controller 18. Further, when the printer 1 shifts from the deep sleep mode to the print mode, the controller 18 controls the transistor Q4 to input the information for identifying the manufacturer to the input port, thus making it possible to identify the type of the manufacturer of the AC/DC board 65 and modify the second condition in accordance with the type of the manufacturer, namely, the degree of the followability, without influencing the printing process.

(12) The followability information may be information indicating whether the image forming job is i) the scan job or the FAX job (each as one example of a first image forming job according to the present disclosure) that causes the temperature of the secondary-side element such as the diode 79A to reach the rated temperature earlier than the temperature of the primary-side element such as the transistor Q1 or ii) the print job (as one example of a second image forming job according to the present disclosure) that causes the temperature of the primary-side element to reach the rated temperature earlier than the temperature of the secondary-side element.

The controller 18 may determine the degree of the followability with respect to the job based on: information as to on which one of the primary side and the secondary side the second temperature sensor 67, 67A is disposed; and information on the type of the received image forming job. This configuration enables the second condition to be modified depending on the degree of the followability.

(13) The second temperature sensor 67 is disposed at a position at which the temperature of the diode 79A on the secondary side is detectable. In this instance, the controller 18 may determine the scan job or the FAX job as the information with high followability and the print job as the information with low followability.

In the arrangement in which the second temperature sensor 67 is disposed so as to detect the temperature of the secondary-side element, when the print job is received, the temperature rise in the secondary-side element such as the diode 79A, namely, the rise in the detection temperature of the second temperature sensor 67, may be delayed as compared with the temperature rise in the primary-side element such as the transistor Q1. In this case, the followability is high with respect to the scan job or the FAX job that causes the temperature of secondary-side element to reach the rated temperature earlier than the temperature of the primary-side element while the followability is low with respect to the print job that causes the temperature of the primary-side element to reach the rated temperature earlier than the temperature of the secondary-side element. By determining the degree of the followability in accordance with the characteristics of the image forming job, the second condition can be appropriately modified.

(14) In a case where normal information cannot be obtained as the followability information (S17: YES), the controller drives the fan 61 (S19) irrespective of the first and second detection temperatures T1, T2 when the printing is performed. When the printing is performed in a situation in which a normal voltage value cannot be obtained as the voltage value indicative of the manufacturer 1, 2, the fan 61 is driven to perform cooling irrespective of the first and second detection temperatures T1, T2. With this configuration, in the event of some malfunction that influences the fan control such as a failure of a circuit of the sensing resistor Rdown, the fan 61 is driven without stopping always when the printing is performed, thus suppressing the temperature rise in the housing 2. The controller 18 may drive the fan 61 without stopping always when the printing is performed in the event of a trouble relating to other factors except for the followability information. For instance, the fan 61 may be rotated without stopping always when the printing is performed in a case where a voltage value, which cannot be usually input from the first and second temperature sensor 62, 67 in a normal operation thereof, is input due to a failure of the first and temperature sensor 62, 67.

(15) The first temperature sensor 62 is disposed outside the enclosure 63 at a position at which the first temperature sensor 62 is farther from the heater 51A than the third temperature sensor 53 is from the heater 51A and at which the first temperature sensor 62 is capable of detecting the temperature of the printing device 12. In this configuration, the temperature detection target of the first temperature sensor 62 is the printing device 12. Accordingly, the temperature rise in the printing device 12 can be detected by the first temperature sensor 62, and the fan 61 can be rotated at appropriate timing.

(16) When at least one of the first and second conditions is satisfied (S39: YES, S45: YES) before the predetermined length of time 110 elapses, the controller 18 rotates the fan 61 that is in the stop state. In a state in which the predetermined length of time 110 elapses and the fan 61 is being rotated at the half speed, the controller 18 maintains the rotation speed of the fan 61 that is being rotated at the half speed even if the first detection temperature T1 becomes not less than the first temperature threshold TH1A or even if the second detection temperature T2 becomes not less than the second temperature threshold. The controller 18 may execute a control of increasing the rotation speed such as increasing from the half speed to the full speed when the first detection temperature T1 becomes not less than the first temperature threshold TH1A, etc., in the state in which the predetermined length of time 110 elapses and the fan 61 is being rotated at the half speed. With this configuration, when at least one of the first and second detection temperatures T1, T2 becomes not less than the temperature threshold, the controller 18 executes a control of driving the fan 61, a control of maintaining the speed of the fan 61, or a control of increasing the rotation speed of the fan 61, so as to execute cooling the interior of the housing 2.

9. Others

It is to be understood that the present disclosure is not limited to the details of the illustrated embodiment but may be modified and changed without departing from the spirit and scope of the present disclosure.

The image forming device in the present disclosure is not limited to the printing device 12 but may be the image reader 13 or the FAX communication device 15.

The image forming apparatus in the present disclosure is not limited to the MFP but may be a monochrome printer, a color printer, a copying machine, a FAX machine, or a scanner.

In the illustrated embodiment, the controller 18 keeps the fan 61 stopped when both the first and second conditions, each of which is for changing the rotation speed of the fan 61 to the half speed, are not satisfied (S45: NO) for the predetermined length of time 110 after starting to execute the print job. The present disclosure is not limited to this configuration. For instance, the controller 18 may rotate the fan 61 at the low speed from the timing when the print job is received or from the timing when the print job starts to be executed and may rotate the fan 61 at the middle speed when at least one of the first condition and the second condition is satisfied (T1≥TH1A, T2≥TH1B).

In the illustrated embodiment, the target rotation speed of the fan 61 when the predetermined length of time 110 elapses is equal to the target rotation speed, i.e., the half speed, when at least one of the first and second conditions is satisfied (S39: YES, S45: YES). The present disclosure is not limited to this configuration. For instance, the controller 18 may control the fan 61 such that the fan 61 is rotated at the low speed when the predetermined length of time 110 elapses and at the middle speed when one of the first and second conditions is satisfied (T1≥TH1A, T2≥TH1B).

The rotation speed may be made different between when the first condition is satisfied and when the second condition is satisfied. For instance, the controller 18 may control the fan 61 such that the fan 61 is rotated at the low speed when the first condition is satisfied (T1≥TH1A), at the middle speed when the second condition is satisfied (T2≥TH1B), and at the high speed when both the first and second conditions are satisfied.

There may be executed a control in which the reception of the image forming job is combined with the first temperature thresholds TH1A-TH4A, the second temperature thresholds TH1B-TH4B. For instance, the controller 18 may rotate the fan 61 at the low speed in response to the reception of the print job as a trigger and may rotate the fan 61 at the middle speed when at least one of the first and second conditions is satisfied (T1≥TH1A, T2≥TH1B).

The controller 18 may not correct the thresholds in the first and second conditions based on the followability information such as the manufacturer of the AC/DC board 65 and the job type. For instance, the controller 18 may set the second temperature thresholds TH1B-TH4B that are the same between the manufacturer 1 and the manufacturer 2.

In the illustrated embodiment, the controller 18 suspends the printing when the first detection temperature T1 becomes equal to the print control threshold TP1 during execution of the print job. It is not necessarily required to suspend the printing.

In the illustrated embodiment, the AC/DC board 65 includes, as the transformer, the transformer 78 for lowering the voltage. The AC/DC board 65 may include a step-up transformer.

In the illustrated embodiment, the printer 1 includes the three temperature sensors, i.e., the first temperature sensor 62, the second temperature sensor 67, and the third temperature sensor 53. The printer 1 may include only at least one temperature sensor, and the printer 1 may be configured to control the fan 61 based on the followability information and the detection temperature by the at least one temperature sensor. For instance, the controller 18 may control the rotation of the fan 61 based on only the information on the manufacturers 1, 2 and the detection temperature by the second temperature sensor 67. The controller 18 may change the second temperature thresholds TH1B-TH4B depending on the manufacturers 1, 2 and may compare the second detection temperature T2 with the changed second temperature thresholds TH1B-TH4B, so as to change the rotation speed of the fan 61. The controller 18 may control the rotation of the fan 61 based on the job type and the detection temperature by the second temperature sensor 67. Accordingly, the controller 18 may obtain the followability information of the temperature detecting element with respect to the temperature of the element mounted on the AC/DC circuit 71 and may modify, based on the followability information, the condition for determining whether the second detection temperature T2 is not less than the second temperature thresholds TH1B, TH2B.

What is claimed is:

1. An image forming apparatus comprising:

a housing;

an image forming device provided in an interior of the housing;

a fan configured to cool the interior of the housing;

an AC/DC board configured to convert an AC voltage supplied from an AC power source into a DC voltage;

a first temperature detecting element configured to output a signal corresponding to a temperature in the housing;

a second temperature detecting element configured to output a signal corresponding to a temperature of an element mounted on the AC/DC board; and a controller connected to the first temperature detecting element and the second temperature detecting element, wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold, and wherein the controller is configured to receive an image forming job that instructs formation of an image by the image forming device, and keep the fan stopped when both the first condition and the second condition are not satisfied for a predetermined length of time after starting to execute the image forming job.

2. The image forming apparatus according to claim 1, wherein the controller starts to control the fan when the predetermined length of time elapses after receiving the image forming job even if both the first condition and the second condition are not satisfied.

3. The image forming apparatus according to claim 1, wherein the image forming job is a print job that instructs execution of printing by the image forming device.

4. The image forming apparatus according to claim 2, wherein the controller is configured to set a target rotation speed at which the fan is rotated when the predetermined length of time elapses so as to be equal to a target rotation speed at which the fan is rotated when at least one of the first condition and the second condition is satisfied.

5. The image forming apparatus according to claim 1, wherein the controller is configured to set a target rotation speed at which the fan is rotated when the first condition is satisfied so as to be equal to a target rotation speed at which the fan is rotated when the second condition is satisfied.

6. The image forming apparatus according to claim 1, wherein the controller is configured to set a target rotation speed at which the fan is rotated when only one of the first condition and the second condition is satisfied so as to be equal to a target rotation speed at which the fan is rotated when both the first condition and the second condition are satisfied.

7. The image forming apparatus according to claim 1, wherein the AC/DC board includes a step-down transformer and a secondary-side element connected to a secondary side of the step-down transformer, and wherein the second temperature detecting element is configured to detect a temperature of the secondary-side element.

8. The image forming apparatus according to claim 7, wherein the secondary-side element is a rectifying diode connected to the secondary side of the step-down transformer.

9. The image forming apparatus according to claim 1, wherein the AC/DC board includes a step-down transformer and a primary-side element connected to a primary side of the step-down transformer, and wherein the second temperature detecting element is configured to detect a temperature of the primary-side element.

10. The image forming apparatus according to claim 1, further comprising:

an enclosure that houses the AC/DC board;

a heater that heats the sheet on which the image is formed by the image forming device; and a third temperature detecting element configured to detect a temperature of the heater, wherein the first temperature detecting element is disposed outside the enclosure at a position at which the first temperature detecting element is farther from the heater than the third temperature detecting element is from the heater and at which the first temperature detecting element is capable of detecting a temperature of the image faulting device.

11. The image forming apparatus according to claim 1, wherein, when at least one of the first condition and the second condition is satisfied, the controller executes one of a control of driving the fan being stopped, a control of maintaining a rotation speed of the fan being driven, and a control of increasing the rotation speed of the fan.

12. An image forming apparatus comprising:

a housing;

an image forming device provided in an interior of the housing;

a fan configured to cool the interior of the housing;

an AC/DC board configured to convert an AC voltage supplied from an AC power source into a DC voltage;

a first temperature detecting element configured to output a signal corresponding to a temperature in the housing;

a second temperature detecting element configured to output a signal corresponding to a temperature of an element mounted on the AC/DC board;

a controller connected to the first temperature detecting element and the second temperature detecting element; and a heater, wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold, wherein the image forming device forms, on a sheet, a toner image with toner, wherein the heater heats the sheet to fix the toner image on the sheet, and wherein the controller is configured to obtain a turn-on cumulative value that is a sum of the number of turn-ons by which the heater is turned on, and start to control the fan when the turn-on cumulative value becomes not less than a cumulative threshold.

13. An image forming apparatus comprising:

a housing;

an image forming device provided in an interior of the housing;

a fan configured to cool the interior of the housing;

an AC/DC board configured to convert an AC voltage supplied from an AC power source into a DC voltage;

a first temperature detecting element configured to output a signal corresponding to a temperature in the housing;

a second temperature detecting element configured to output a signal corresponding to a temperature of an element mounted on the AC/DC board; and a controller connected to the first temperature detecting element and the second temperature detecting element, wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold, and wherein the controller is configured to obtain followability information that is information on followability of the second temperature detecting element with respect to the temperature of the element mounted on the AC/DC board, and modify the second condition based on the followability information.

14. The image forming apparatus according to claim 13, wherein, as a processing of modifying the second condition, the controller sets the second temperature threshold when the followability information indicative of low followability is obtained so as to be lower than the second temperature threshold when the followability information indicative of high followability is obtained.

15. The image forming apparatus according to claim 13, wherein the followability information is information indicative of a type of the AC/DC board.

16. The image fainting apparatus according to claim 15, further comprising a switch element, wherein the controller includes an input port, wherein the input port is configured such that a first signal of the second temperature detecting element and a second signal corresponding to the type of the AC/DC board are input thereto, wherein the switch element is configured to switch a signal input to the input port between the first signal and the second signal, and wherein the controller is configured to control the switch element to switch the signal input to the input port such that the second signal is input to the input port.

17. The image forming apparatus according to claim 13, wherein the AC/DC board includes:

a transformer;

a primary-side element connected to a primary side of the transformer; and a secondary-side element connected to a secondary side of the transformer;

wherein the controller is configured to receive an image forming job that instructs formation of an image by the image forming device, and wherein the followability information is information indicating whether the image forming job is a first image forming job that causes a temperature of the secondary-side element to reach a rated temperature earlier than a temperature of the primary-side element or a second image forming job that causes the temperature of the primary-side element to reach a rated temperature earlier than the temperature of the secondary-side element.

18. The image forming apparatus according to claim 17, wherein the second temperature detecting element is configured to detect the temperature of the secondary-side element, and wherein the controller is configured to determine the first image forming job as information indicative of high followability and determine the second image forming job as information indicative of low followability.

19. The image forming apparatus according to claim 18, further comprising a heater and a triac configured to switch energization to the heater, wherein the image forming device forms, on a sheet, a toner image with toner, wherein the heater heats the sheet to fix the toner image on the sheet, wherein the primary-side element is the triac, wherein the second image forming job is a print job that causes the image forming device to execute printing, and wherein the first image forming job is a job that causes the image forming device to execute formation of an image other than the printing.

20. The image forming apparatus according to claim 13, wherein, in a case where normal information is not obtained as the followability information, the controller drives the fan irrespective of the first detection temperature and the second detection temperature when formation of an image by the image forming device is executed.

21. An image forming apparatus comprising:

a housing;

an image forming device provided in an interior of the housing;

a fan configured to cool the interior of the housing;

an AC/DC board configured to convert an AC voltage supplied from an AC power source into a DC voltage;

a first temperature detecting element configured to output a signal corresponding to a temperature in the housing;

a second temperature detecting element configured to output a signal corresponding to a temperature of an element mounted on the AC/DC board;

a controller connected to the first temperature detecting element and the second temperature detecting element; and a heater, wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold, wherein the image forming device forms, on a sheet, a toner image with toner, wherein the heater heats the sheet to fix the toner image on the sheet, and wherein the controller is configured to obtain a turn-on cumulative value that is a sum of the number of turn-ons by which the heart is turned on, start to control the fan when the turn-on cumulative value becomes not less than a cumulative threshold, obtain followability information that is information on followability of the second temperature detecting element with respect to the temperature of the element mounted on the AC/DC board, and set the cumulative threshold when the followability information indicative of low followability is obtained so as to be lower than the cumulative threshold when the followability information indicative of high followability is obtained.

22. An image forming apparatus comprising:

a housing;

an image forming device provided in an interior of the housing;

a fan configured to cool the interior of the housing;

an AC/DC board configured to convert an AC voltage supplied from an AC power source into a DC voltage;

a first temperature detecting element configured to output a signal corresponding to a temperature in the housing;

a second temperature detecting element configured to output a signal corresponding to a temperature of an element mounted on the AC/DC board; and a controller connected to the first temperature detecting element and the second temperature detecting element;

wherein the controller controls the fan when at least one of a first condition and a second condition is satisfied, the first condition being a condition in which a first detection temperature detected based on the signal received from the first temperature detecting element is not less than a first temperature threshold, the second condition being a condition in which a second detection temperature detected based on the signal received from the second temperature detecting element is not less than a second temperature threshold, wherein the AC/DC hoard includes a step-down transformer and a primary-side element connected to a primary side of the step-down transformer, wherein the second temperature detecting element is configured to detect a temperature of the primary-side element, wherein the image forming apparatus further comprises a heater and a triac connected to the primary side of the step-down transformer and configured to switch energization to the heater, and wherein the primary-side element is the triac.

23. An image forming apparatus, comprising:

a housing;

an image forming device provided in an interior of the housing;

a fan configured to cool the interior of the housing;

an AC/DC board configured to convert an AC voltage supplied from an AC power source to a DC voltage;

a temperature detecting element configured to output a signal corresponding to a temperature of an element mounted on the AC/DC board; and a controller connected to the temperature detecting element, the controller being configured to control the fan when a detection temperature detected based on the signal received from the temperature detecting element becomes not less than a temperature threshold, wherein the controller is configured to:

obtain followability information that is information on followability of the temperature detecting element with respect to the temperature of the element mounted on the AC/DC board; and modify, based on the followability information, a condition for determining whether the detection temperature is not less than the temperature threshold.

* * * * *